US011236575B2

(12) United States Patent
Dietrich et al.

(10) Patent No.: US 11,236,575 B2
(45) Date of Patent: Feb. 1, 2022

(54) ROTATING CONTROL DEVICE WITH MULTIPLE SEAL CARTRIDGE

(71) Applicant: NTDrill Holdings, LLC, Houston, TX (US)

(72) Inventors: Earl Dietrich, Fulshear, TX (US); Christian Leuchtenberg, Shamrock Park (SG); Philip J. Engelman, Ham Lake, MN (US); Jeffrey S. Meister, Ham Lake, MN (US); Daniel E. Sabelko, Otsego, MN (US); Nicolas A. Haugen, St. Louis Park, MN (US)

(73) Assignee: NTDrill Holdings, LLC, Houston, TX (US)

( * ) Notice: Subject to any disclaimer, the term of this patent is extended or adjusted under 35 U.S.C. 154(b) by 13 days.

(21) Appl. No.: 16/744,258

(22) Filed: Jan. 16, 2020

(65) Prior Publication Data

US 2020/0232297 A1 Jul. 23, 2020

Related U.S. Application Data

(60) Provisional application No. 62/793,457, filed on Jan. 17, 2019.

(30) Foreign Application Priority Data

Feb. 28, 2019 (GB) ..... 1902688

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS 2,173,192 A 9/1939 Williams
4,304,310 A * 12/1981 Garrett ..... E21B 33/085 166/84.3

(Continued)

FOREIGN PATENT DOCUMENTS

EP 1469243 A1 10/2004
WO 2016025264 A1 2/2016

OTHER PUBLICATIONS

Kalsi Engineering, Inc., Kalsi Seals Handbook Chapter D18 Pressure Staging, Revision 2, Oct. 7, 2016.

(Continued)

*Primary Examiner* — Matthew R Buck
(74) *Attorney, Agent, or Firm* — Young Basile Hanlon & MacFarlane, P.C.

(57) ABSTRACT

The disclosure relates to a rotating control device used in a drilling system having a non-rotating tubular RCD housing enclosing an elongate passage. A mandrel rotatably extends along the passage about an axis. A seal assembly seals the RCD housing to the mandrel and provides first and second seals against the mandrel's exterior surface. The first and second seals are spaced parallel to the mandrel's axis to create space between the mandrel and the first and second seals. The first seal has a first side exposed to fluid pressure in the RCD housing and a second side exposed to fluid in the space between the seals. The second seal has a first side exposed to fluid pressure in the space between the seals and a second side exposed to fluid pressure at the exterior of the RCD housing. A pressure stepping mechanism supplies fluid to the space between the two seals.

21 Claims, 13 Drawing Sheets

(56) References Cited

U.S. PATENT DOCUMENTS

| | | | | |
|---|---|---|---|---|
| 4,312,404 | A * | 1/1982 | Morrow | E21B 33/085 166/84.3 |
| 4,416,340 | A * | 11/1983 | Bailey | E21B 33/085 175/195 |
| 4,754,820 | A * | 7/1988 | Watts | E21B 33/04 175/195 |
| 5,195,754 | A | 3/1993 | Kalsi | |
| 5,636,847 | A | 6/1997 | Chesterton | |
| 6,007,105 | A | 12/1999 | Kalsi | |
| 6,102,139 | A | 8/2000 | Wirth | |
| 6,161,838 | A | 12/2000 | Bal | |
| 6,164,660 | A | 12/2000 | Saint-Gobain | |
| 6,227,547 | B1 | 5/2001 | Kalsi | |
| 8,720,543 | B2 | 5/2014 | Meling et al. | |
| 9,284,811 | B2 * | 3/2016 | Michaud | E21B 33/08 |
| 9,316,319 | B2 | 4/2016 | Kalsi | |
| 9,567,817 | B2 | 2/2017 | Chambers | |
| 10,066,664 | B2 * | 9/2018 | Cooper | F16C 33/667 |
| 10,435,981 | B2 * | 10/2019 | Richie | F16J 15/006 |
| 2005/0206090 | A1 * | 9/2005 | Bunn | F16J 15/3212 277/549 |
| 2007/0080501 | A1 * | 4/2007 | Schroeder | E21B 3/02 277/437 |
| 2008/0067754 | A1 * | 3/2008 | Schroeder | F16J 15/006 277/437 |
| 2017/0114606 | A1 | 4/2017 | Bailey et al. | |
| 2017/0167221 | A1 | 6/2017 | Reinhardt | |

OTHER PUBLICATIONS

Kalsi Engineering, Inc., Kalsi Seals Handbook Chapter E1 Using Kalsi Seals in RCDs with lubricant overpressure, Revision 5, Jun. 20, 2017.

United Kingdom Intellectual Property Office, Search Report for Great Britain Patent Application No. GB1902688.9, dated Jul. 8, 2019.

* cited by examiner

ROTATING CONTROL DEVICE WITH MULTIPLE SEAL CARTRIDGE

CROSS-REFERENCE TO RELATED APPLICATION

The application claims the benefit of U.S. Provisional Patent Application Ser. No. 62/793,457, filed on Jan. 17, 2019, and Great Britain Patent Application Serial. No. GB 1902688.9, filed on Feb. 28, 2019, both of which are incorporated in their entirety by reference.

TECHNICAL FIELD

This disclosure relates in general to fluid drilling equipment and in particular to a rotating control device (RCD) to be used for drilling operations. More specifically, embodiments of the present disclosure relate to a RCD having a multiple seal assembly that increases bearing performance and life by ensuring a reliable seal from wellbore pressure.

BACKGROUND

In drilling a well, a drilling tool or "drill bit" is rotated under an axial load within a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating control devices provide a means of sealing off the annulus around the drill pipe as the drill pipe rotates and translates axially down the well while including a side outlet through which the return drilling fluid is diverted. Such rotating control devices may also be referred to as rotating blow out preventers, rotating diverters or drilling heads. These units generally comprise a stationary housing or bowl including a side outlet for connection to a fluid return line and an inlet flange for locating the unit on a blowout preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe which is typically made from rubber, polyurethane or another suitable elastomer.

For offshore application on jack-up drilling rigs or floating drilling rigs, the rotating control device may be in the form of a cartridge assembly that is latched inside the drilling fluid return riser. In this case, the side outlet may be on a separate spool or outlet on the riser.

The demands made on modern RCDs are pushing the envelope and limit of what is achievable with elastomeric seal solutions. The trend is for RCDs to be able to provide effective sealing at higher pressures and higher rotational speeds. Advances in the drill string rotation equipment like top drives used to rotate the drill string and hence the drilling bit are allowing revolution rates as high as 300 rpm. There is a desire to be able to use RCDs at much higher pressures during well control operations to enable drill string rotation so as to avoid getting stuck which is a common problem. These types of operations could be carried out if the dynamic rating of the seal solution was comparable to the static housing pressure rating of the RCD which is typically 5000 psi for the high-pressure variants. Furthermore, there is a need to increase the service interval for changing out the seal assembly which is typically failing in less than 200 hours. Premature seal assembly failure leads to drilling fluid invasion of the bearing assembly with consequent costly failure.

The problem is being continuously addressed by novel ways of arranging the seals such as disclosed in U.S. Pat. No. 9,284,811 assigned to Schlumberger Technology Corporation. Another method is to force lubricate the bearings and seals of which there are many examples, a recent one being the U.S. Pat. No. 10,066,664 assigned to Black Gold Tools, Inc.

Most modern high-pressure RCDs use elastomeric lip seals or hydrodynamic film seals, with the most common ones in use being the wave seals called KALSI™ seals, marketed by Kalsi Engineering, Inc. of Sugar Land, Tex. USA. The only way to improve the performance of seal assemblies using these types of seals is by reducing the pressure and velocity (PV) experienced by such seal assemblies. PV value is a seal design number calculated by the Pressure in psi multiplied by the surface Velocity of the application. Taking a typical rpm of 200, a typical RCD mandrel diameter of 9 inches, we get a surface Velocity of about 471 sfpm. Considering the modern PV limit of lip seals is around 250,000, it means that it gets difficult to achieve sealing pressures in excess of 500 psi which gives a PV of 471 multiplied by 500 which is equal to 235,500, so close to the PV limit of a lip seal.

Such improvements are the subject of recent applications US20170114606A1 and US20170167221A1, both by Weatherford Technology Holdings. '606 discloses a stepped pressure concept to lower the pressure differential across the seals, thus reducing the PV per seal. The other application '221 discloses a split seal assembly that reduces the individual velocity across each seal by reducing the ratio of rpm by use of independently rotating rings which also reduces the total PV seen per seal. Additionally, these design use methods for pressurizing the internal lubrication fluid for the bearings so as to provide reduced pressure differentials. The drawback of using the Kalsi type seal solution is that they must continuously weep to lubricate the interface and that they are harder seals than lip seals leading to wear on the rotating mandrel which eventually also causes leaks.

Also, these recent seal assemblies involving multiple components are labor intensive to service, as they need to be disassembled piece by piece and rebuilt. There is a need for having a multiple seal solution that can be simply replaced as a cartridge using the same type and diameter of seal which can be easily adapted to the pressure requirements by staging the pressure experienced by each seal so that each seal operates within the PV limits of its design. Such a solution would use a lip type seal which does not allow any leakage when operating under the recommended PV conditions.

A recent staged pressure seal solution for a dual drill pipe is disclosed in U.S. Pat. No. 8,720,543 assigned to Reelwell A S. This does not allow for a cartridge replacement of the seal assembly.

It is an object of the present invention to provide a pressure staged lip seal assembly for an RCD application with improved reliability under the difficult operating conditions for a high-pressure RCD. The advantageous design houses all of the seals and pressure staging components in a single cartridge that is easily replaceable for quick servicing.

SUMMARY

The present disclosure includes a rotating control device with a seal cartridge having multiple, identical, common diameter lip seals with pressure staging in a single cartridge assembly that can be easily installed and removed without dismantling the main mandrel and bearings. Advantageously, a series pressure staging mechanism is disclosed.

According to one embodiment of the present disclosure, a rotating control device is provided for use in a drilling system, wherein the rotating control device comprises a non-rotating tubular RCD housing enclosing an elongate passage. A mandrel extends along the elongate passage and has an axis and an end on which is mounted an elastomeric stripper which is located in the RCD housing and which is configured to seal against and rotate relative to the RCD housing about said axis with a drill pipe located inside the mandrel and extending along said axis. A seal assembly is configured to provide a substantially fluid tight seal between the RCD housing and the mandrel and has a seal support housing with first and second seals which seal against an exterior surface of the mandrel. The first and second seals are spaced from one another generally parallel to the axis of the mandrel so that there is a space around the mandrel between the first and second seals. The first seal has a first side which is exposed to fluid at a pressure greater than or equal to the pressure of fluid in the RCD housing and a second side which is exposed to fluid in the space between the seals. The second seal has a first side which is exposed to fluid pressure in the space between the seals and a second side which is exposed to fluid pressure at the exterior of the RCD housing. A pressure stepping mechanism pressurizes fluid to a pressure which is intermediate between the pressure at the first side of the first seal and the pressure at the second side of the second seal and supplies said fluid to the space between the two seals. The pressure stepping mechanism is integral with or secured to the seal support housing.

The seal assembly may comprise at least one intermediate seal which is located in the space between the first seal and the second seal and divides the space around the mandrel between the first seal and the second seal into a plurality of spaces which are spaced from one another generally parallel to the axis of the mandrel. The at least one intermediate seal has a first side which is exposed to fluid pressure in the space between it and the first seal or its adjacent seal closest to the first seal and a second side which is exposed to fluid pressure in the space between it and the second seal or its adjacent seal closest to the second seal. The pressure stepping mechanism is configured to supply fluid to each space between adjacent seals, wherein the pressure of fluid supplied to the space between the first seal and its adjacent seal is lower than the pressure of fluid in the RCD housing. The pressure of fluid supplied to the space between the second seal and its adjacent seal is greater than the fluid pressure at the exterior of the RCD housing but lower than the pressure of fluid supplied to the space between the first seal and its adjacent seal. The fluid pressure in all the spaces between adjacent seals decreases from the space adjacent the first seal to the space adjacent the second seal.

The pressure stepping mechanism may be configured to adjust the pressure of fluid supplied to each of the spaces between adjacent seals such that the pressure differential from the first side to the second side of each seal is substantially the same.

The pressure stepping mechanism may comprise, for each space between adjacent seals, a cylinder containing a piston which divides the cylinder into an inlet volume and an outlet volume, wherein the outlet volume is in fluid communication with its respective space between adjacent seals. The piston has an inlet face which is exposed to fluid pressure in the inlet volume and an outlet face which is exposed to fluid pressure in the outlet volume, wherein the area of the inlet face is less than the area of the outlet face.

The or each cylinder of the pressure stepping mechanism and the fluid connections to the inlet and outlet volumes of the or each cylinder may be integral with or secured to the seal support housing.

The cylinders of the pressure stepping mechanism may be identical in external dimensions.

The pressure stepping mechanism may be configured such that the inlet volume of each cylinder is in fluid communication with fluid in the RCD housing or with fluid at the same pressure as fluid in the RCD housing or with fluid at the first side of the first seal.

The inlet volume of the or each cylinder may be protected from direct contact with the fluid in the RCD housing by a diaphragm.

The seal assembly may comprise at least one intermediate seal which is located in the space between the first seal and the second seal and divides the space around the mandrel between the first seal and the second seal into a plurality of spaces which are spaced from one another generally parallel to the axis of the mandrel. The at least one intermediate seal has a first side which is exposed to fluid pressure in the space between it and the first seal or its adjacent seal closest to the first seal and a second side which is exposed to fluid pressure in the space between it and the second seal or its adjacent seal closest to the second seal. The pressure stepping mechanism is configured to supply fluid to each space between adjacent seals, wherein the pressure of fluid supplied to the space between the first seal and its adjacent seal is lower than the pressure of fluid at the first side of the first seal. The pressure of fluid supplied to the space between the second seal and its adjacent seal is greater than the fluid pressure at the exterior of the RCD housing but lower than the pressure of fluid supplied to the space between the first seal and its adjacent seal. The fluid pressure in all the spaces between adjacent seals decreases from the space adjacent the first seal to the space adjacent the second seal, and the ratio of the area of the inlet face to the area of the outlet face of each piston decreases moving from the piston controlling the supply of pressurized fluid to the space adjacent the first seal to the piston controlling the supply of pressurized fluid to the space adjacent the second seal.

The seal assembly may comprise at least one intermediate seal which is located in the space between the first seal and the second seal and divides the space around the mandrel between the first seal and the second seal into a plurality of spaces which are spaced from one another generally parallel to the axis of the mandrel. The at least one intermediate seal having a first side which is exposed to fluid pressure in the space between it and the first seal or its adjacent seal closest to the first seal and a second side which is exposed to fluid pressure in the space between it and the second seal or its adjacent seal closest to the second seal. The pressure stepping mechanism being configured to supply fluid to each space between adjacent seals, wherein the pressure of fluid being supplied to the space between the first seal and its adjacent seal is lower than the pressure of the fluid at the first side of the first seal. The pressure of fluid supplied to the space between the second seal and its adjacent seal is greater than the fluid pressure at the exterior of the RCD housing but lower than the pressure of fluid supplied to the space between the first seal and its adjacent seal. The fluid pressure in all the spaces between adjacent seals decreases from the space adjacent the first seal to the space adjacent the second seal, wherein the pressure stepping mechanism has a first cylinder which controls the supply of pressurized fluid to the space adjacent the first seal. The inlet volume of the first cylinder is in fluid communication with fluid in the RCD housing or with fluid at the same pressure as fluid in the RCD housing or with fluid at the first side of the first seal, whilst the inlet volumes of all other cylinders are each in communication with the outlet volume of the cylinder controlling the supply of pressurized fluid to the space adjacent to its respective space and closer to the first seal (its preceding cylinder) so that the pressure in the inlet volume of each of the other cylinders is substantially the same as the pressure in the outlet volume of its preceding cylinder.

For each cylinder other than the first cylinder, a fluid flow passage may be provided between the inlet volume and the outlet volume of its preceding cylinder.

The inlet volume of the first cylinder may be protected from direct contact with fluid in the RCD housing by a diaphragm.

The pressure stepping mechanism may comprise a supply cylinder having a supply piston which divides the cylinder into an inlet volume and an outlet volume, wherein the inlet volume is in fluid communication with fluid in the RCD housing, and the outlet volume is in fluid communication with the inlet volume of the first cylinder. The supply piston has an inlet face which is exposed to fluid pressure in the inlet volume and an outlet face which is exposed to fluid pressure in the outlet volume, wherein the area of the inlet face is substantially the same as the area of the outlet face.

The rotating control device may further comprise a trash seal which seals against an exterior surface of the mandrel and is adjacent to but spaced from the first side of the first seal, so as to form a space around the mandrel between the trash seal and the first seal. The trash seal has a first side which is exposed to fluid in the RCD housing and a second side which is exposed to fluid in the space between it and the first side of the first seal.

The trash seal may be a non-pressure isolating seal.

The trash seal may be a pressure isolating seal, and the pressure stepping mechanism includes means for supplying fluid to the space between the trash seal and the first seal at a pressure which is the same or greater than the fluid in the RCD housing.

The pressure stepping mechanism may include a trash supply cylinder having a trash supply piston which divides the cylinder into an inlet volume and an outlet volume, wherein the inlet volume is in fluid communication with fluid in the RCD housing, and the outlet volume is in fluid communication with the space between the trash seal and the first seal. The trash supply piston has an inlet face which is exposed to fluid pressure in the inlet volume and an outlet face which is exposed to fluid pressure in the outlet volume, wherein the area of the inlet face is substantially the same as the area of the outlet face.

The pressure stepping mechanism may include a trash supply cylinder having a trash supply piston which divides the cylinder into an inlet volume and an outlet volume, wherein the inlet volume is in fluid communication with fluid in the RCD housing, and the outlet volume is in fluid communication with the space between the trash seal and the first seal. The trash supply piston has an inlet face which is exposed to fluid pressure in the inlet volume and an outlet face which is exposed to fluid pressure in the outlet volume, wherein the area of the inlet face is larger than the area of the outlet face.

The seals may seal against a seal sleeve which is mounted on the exterior of the mandrel and fixed for rotation with the mandrel, wherein the seal sleeve is removable from the mandrel.

The rotating control device may further comprise a seal adjustment mechanism which is operable to move the seals relative to the seal sleeve generally parallel to the axis of the mandrel without detaching either the seal sleeve from the mandrel or the seal assembly from the RCD housing.

The seal support housing may be secured to the RCD housing so that rotation of the seal support housing relative to the RCD housing is substantially prevented.

Each seal may be located in a separate seal carrier within the seal support housing, wherein each seal carrier is provided with a pressure isolating seal which provides a substantially fluid tight seal between the seal carrier and the seal support housing.

The rotating control device may further comprise a bearing assembly which supports the mandrel for rotation in the RCD housing, wherein the seal assembly is arranged to isolate the bearing assembly from pressurized fluid in the RCD housing and engages with the mandrel between the stripper and the bearing assembly.

According to another embodiment of the present disclosure, a rotating control device for use in a drilling system provides a non-rotating tubular RCD housing enclosing an elongate passage. A mandrel extends along the elongate passage and has an axis and is configured in use to rotate relative to the RCD housing about said axis. A seal assembly is configured to provide a substantially fluid tight seal between the RCD housing and the mandrel, wherein the seal assembly comprises a seal support housing with first and second seals which seal against an exterior surface of the mandrel. The first and second seals are spaced from one another generally parallel to the axis of the mandrel so that there is a space around the mandrel between the first and second seals, wherein the first seal has a first side which is exposed to fluid at a pressure greater than or equal to the pressure of fluid in the RCD housing and a second side which is exposed to fluid in the space between the seals. The second seal has a first side which is exposed to fluid pressure in the space between the seals and a second side which is exposed to fluid pressure at the exterior of the RCD housing. A pressure stepping mechanism pressurizes fluid to a pressure which is intermediate between the pressure at the first side of the first seal and the pressure at the second side of the second seal and supplies the fluid to the space between the two seals, wherein the pressure stepping mechanism is integral with or secured to the seal support housing and the seals, seal support housing, and pressure stepping mechanism are located inside the RCD housing and are releasably attached to the RCD housing and can be removed from the RCD housing together as a single unit.

The seals may seal against a seal sleeve which is mounted on the exterior of the mandrel and fixed for rotation with the mandrel, wherein the seal sleeve is detachable from the mandrel for removal from the RCD housing with the seals, seal support housing, and pressure stepping mechanism.

Each seal may be located in a separate seal carrier within the seal support housing, wherein each seal carrier is provided with a pressure isolating seal which provides a substantially fluid tight seal between the seal carrier and the seal support housing. The seal support housing, seal carriers, and pressure stepping mechanism are releasably attached to the RCD housing and can be removed from the RCD together as a single unit.

The rotating control device may further comprise a bearing assembly which supports the mandrel for rotation in the RCD housing, wherein the seal assembly is arranged to isolate the bearing assembly from pressurized fluid in the RCD housing, and the seals, seal support housing, and pressure stepping mechanism are releasably attached to the RCD housing and removable from the RCD housing together as a single unit whilst leaving the mandrel and bearing assembly in place in the RCD housing.

The RCD housing may comprise an upper housing and a lower housing, and the rotating control device may comprise a locking mechanism wherein the upper housing may be locked to the lower housing. The locking mechanism is operable to release the upper housing from the lower housing, wherein the seals, seal support housing, and pressure stepping mechanism are releasably attached to the upper housing. In this case, the bearing assembly may be located in the upper housing. Moreover, the lower housing may be provided with a mounting spool, which may comprise a flange, wherein the lower housing may be secured to another part of a drilling system such as a blowout preventer or riser.

According to yet another embodiment, a rotating control device for use in a drilling system provides a non-rotating tubular RCD housing enclosing an elongate passage. A mandrel extends along the elongate passage and has an axis and is configured in use to rotate relative to the RCD housing about said axis. A bearing assembly supports the mandrel for rotation in the RCD housing, and a seal assembly is configured to provide a substantially fluid tight seal between the RCD housing and the mandrel and to isolate the bearing assembly from pressurized fluid in the RCD housing. The seal assembly includes a seal support housing with first and second seals which seal against an exterior surface of the mandrel, wherein the first and second seals are spaced from one another generally parallel to the axis of the mandrel so that there is a space around the mandrel between the first and second seals. The first seal has a first side which is exposed to fluid at a pressure greater than or equal to the pressure of fluid in the RCD housing and a second side which is exposed to fluid in the space between the seals. The second seal has a first side which is exposed to fluid pressure in the space between the seals and a second side which is exposed to fluid pressure at the exterior of the RCD housing. A pressure stepping mechanism pressurizes fluid to a pressure which is intermediate between the pressure at the first side of the first seal and the pressure at the second side of the second seal and supplies said fluid to the space between the two seals. The pressure stepping mechanism is integral with or secured to the seal support housing, wherein the seals, seal support housing, and pressure stepping mechanism are releasably attached to the RCD housing, and can be removed from the RCD together as a single unit, whilst leaving the mandrel and bearing assembly in place in the RCD housing.

The seals may seal against a seal sleeve which is mounted on the exterior of the mandrel and fixed for rotation with the mandrel, wherein the seal sleeve is detachable from the mandrel for removal from the RCD housing with the seals, seal support housing, and pressure stepping mechanism.

Each seal may be located in a separate seal carrier within the seal support housing, wherein each seal carrier is provided with a pressure isolating seal which provides a substantially fluid tight seal between the seal carrier and the seal support housing. The seal support housing, seal carriers, and pressure stepping mechanism are releasably attached to the RCD housing and can be removed from the RCD together as a single unit.

The RCD housing may comprise an upper housing and a lower housing, and the rotating control device may comprise a locking mechanism wherein the upper housing may be locked to the lower housing. The locking mechanism is operable to release the upper housing from the lower housing, wherein the seals, seal support housing, and pressure stepping mechanism are releasably attached to the upper housing. In this case, the bearing assembly may be located in the upper housing. Moreover, the lower housing may be provided with a mounting spool, which may comprise a flange, wherein the lower housing may be secured to another part of a drilling system such as a blowout preventer or riser.

The rotating control devices according to the disclosed embodiments may also have a combination of features from each of the disclosed embodiments of the rotating control device.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTIONS

The problems being solved and the solutions provided by the embodiments of the principles of the present disclosure are best understood by referring to FIGS. 1 to 12 of the drawings, in which like numbers designate like parts.

Figure 1:
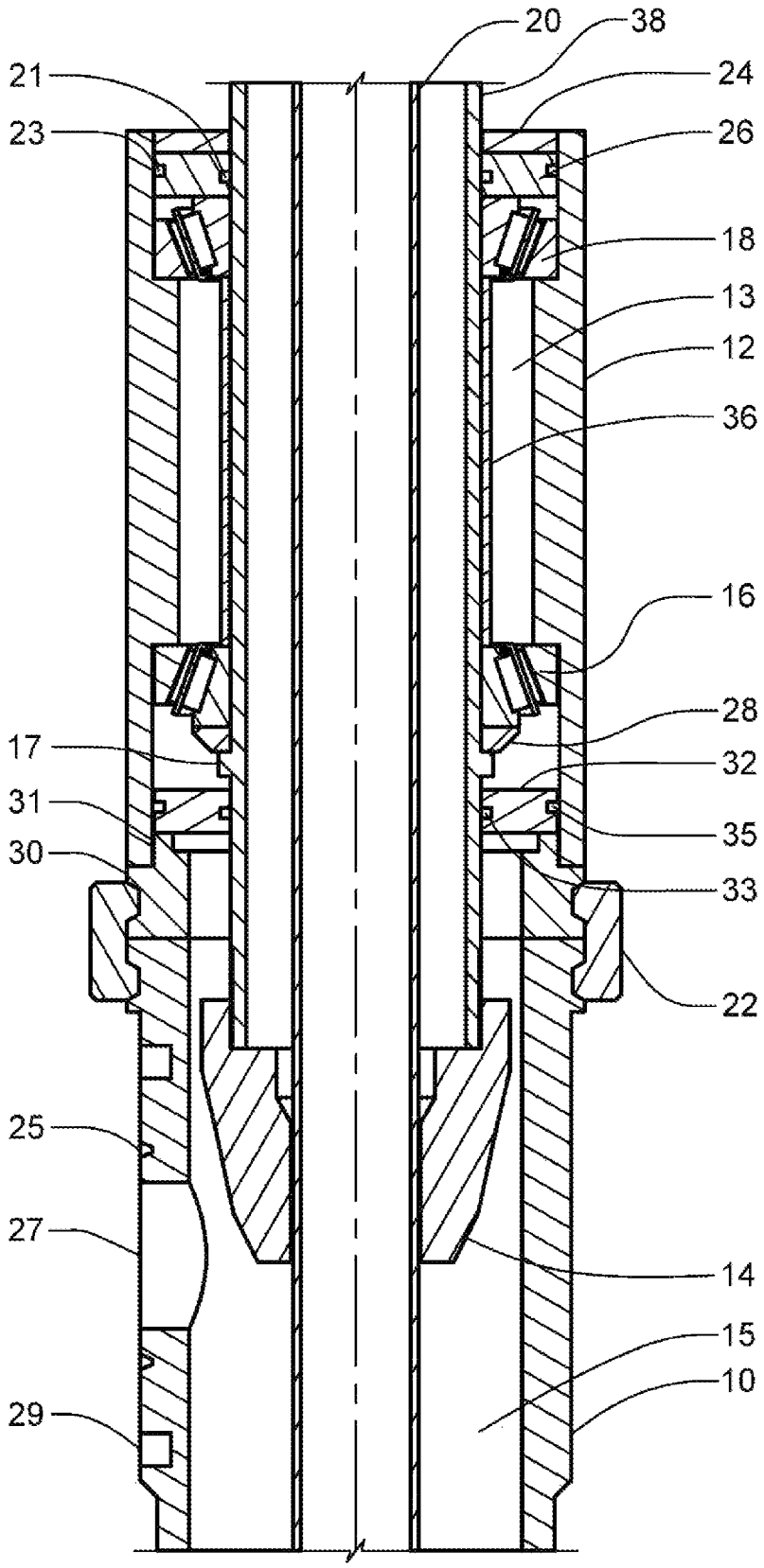
FIG. 1 (PRIOR ART)
FIG. 1 is a cross-sectional view of a typical prior art rotating control device design.

FIG. 1 is a schematic cross section of a typical prior art rotating control device. It will serve to illustrate the common current methods of achieving sealing. We have a RCD with an upper housing 12 and a lower housing 10, and a locking mechanism whereby the upper housing 12 may be secured to the lower housing 10. In this embodiment, the upper housing 12 has an adapter 30 threaded at 31 to enable a clamp 22 to connect the upper housing 12 to the lower housing 10. This is a usual arrangement for land RCDs. The assembly may be in one piece and latched into a drilling riser below the slip joint for a floating drilling rig or latched into a diverter just above the BOP on a jack-up drilling rig. A drillpipe 20 is running through the RCD assembly and sealed with a stripper element 14 attached to the RCD mandrel 38. There is a side outlet 27 with a seal groove 25 and stud holes 29 for bolting on a side outlet adapter. The pressure load from the stripper element 14, due to pressure in a cavity 15 when drilling with pressure, is transmitted via a load shoulder 17 on the RCD mandrel 38 via a spacer ring 28. The load is distributed between two sets of conical roller bearings, lower 16 and upper 18, with a spacer sleeve 36. The mandrel 38 is free to rotate as the drillpipe 20 rotates and frictionally transmits the torque through the stripper element 14, transmits this rotation to the mandrel. The upper part of the upper housing 12 has a retention plate 24 with a seal carrier 26 below it which is sealed with a static seal 23 to the housing 12. A dynamic seal 21 seals a bearing cavity 13 from the outside environment. The seal 21 may be a sealing system consisting of multiple seals like an excluder seal and a dynamic seal. A similar seal carrier 32 seals the bearing cavity 13 against the wellbore pressure in the cavity 15. It will have a similar static seal 35 as for the upper carrier and a dynamic seal assembly 33 which can have one or more seals. The exact solution depends on the design of the RCD and whether there is pressurized oil supply to the cavity 13, or just a pre-charge pressure in the cavity 13. The sealing solutions become very complex as the PV limits of KALSI or lip seals are reached as illustrated in the prior art references, meaning that the seal carriers 26 and 32 may have multiple seals and complexities.

Figure 2:
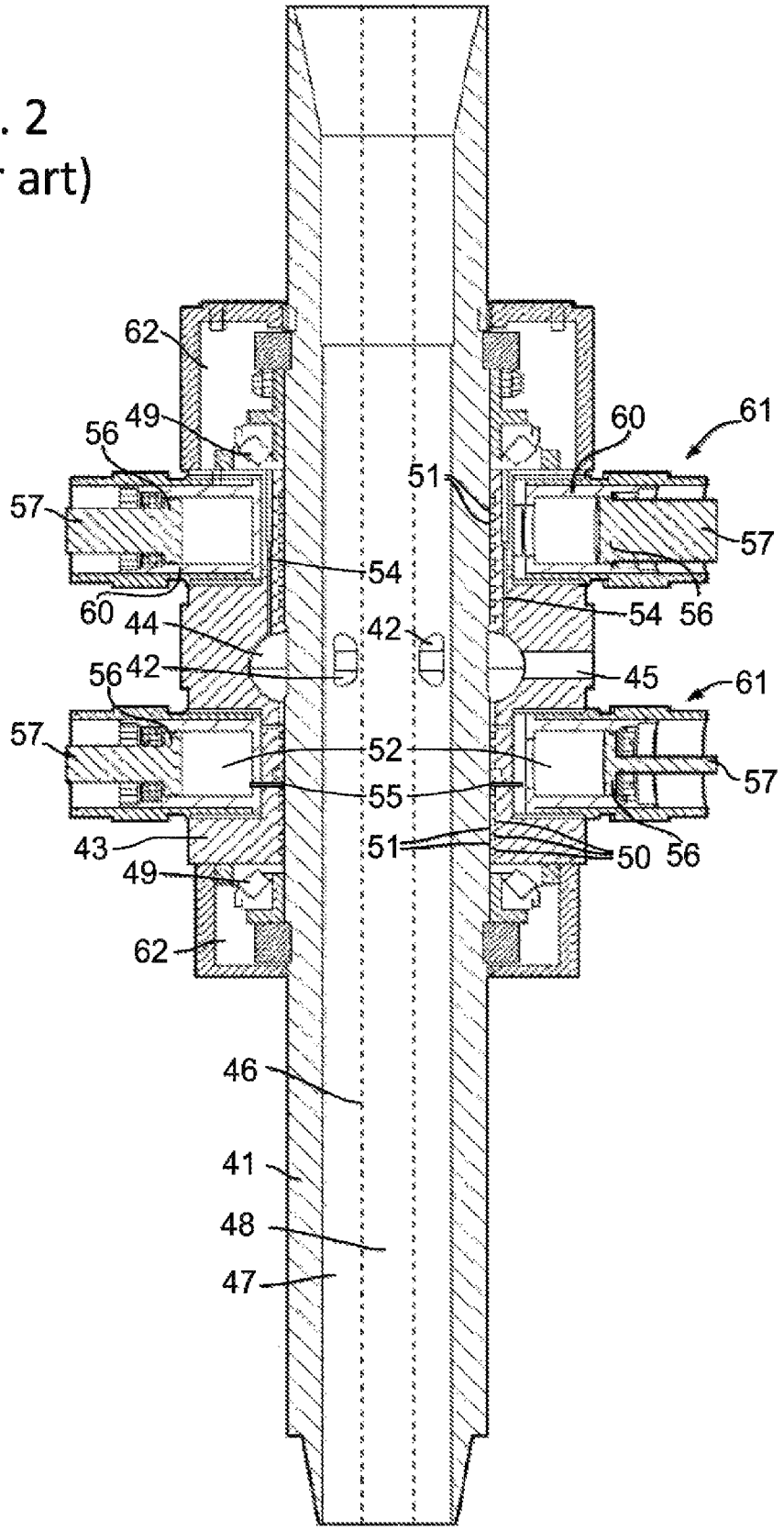
FIG. 2 (Prior art)
FIG. 2 is a cross-sectional view of a prior art parallel pressure staging seal design for a dual drill pipe swivel.

FIG. 2 is a prior art design cross section for a dual drillpipe swivel. A drillpipe 41 is formed with holes 42 through the wall of the drillpipe 41. These holes 42 lead to an inner annular cavity 44 formed in the inner surface of a washpipe 43. This inner annular cavity 44 is in connection with the outside through an opening 45. Between the opposing surfaces of the washpipe 43 and the drillpipe 41, there are arranged several sealing elements 50, in series, on both sides of the annular cavity 44. The sealing elements 50 are annular sealing elements and are arranged within grooves in the washpipe 43. As these sealing elements 50 are arranged around the circumference of the drillpipe 41 and in abutment against the drillpipe 41 and the washpipe 43, there are formed annular spaces 51 between two neighbouring sealing elements 50. There are nine sealing elements 50 arranged in series on both sides of the annular cavity 44 in the shown example. The series of sealing elements 50 may comprise three or more sealing elements 50 forming at least two annular spaces 51. There may be, for instance, five, six, seven or eight sealing elements forming four, five, six or seven annular spaces. There are similar series of sealing elements 50 on both sides of the annular cavity 44. The wash pipe 43 is formed between two pipe flanges 62 attached to the drillpipe 41 with bearing arrangements 49 between the washpipe 43 and the pipe flanges 62 allowing and supporting relative rotational movement between the drillpipe 41 and the washpipe 43. There is partly within the washpipe 43 arranged several compensator devices 61. The compensator devices 61 comprise a cylinder 60, wherein there is arranged a movable piston 56. The cylinders 60 and pistons 56 are similar for all the compensator devices 61. There is a sealing connection between the pistons and cylinders. To the piston 56, there is attached a piston rod 57. The cross-sectional area of the piston rod 57 is varied from one compensator device 61*a* to the next compensator device 61'. As one can see from FIG. 2, the piston rods 57 extend out of the compensator device and work as a visual aid. The compensator devices 61 are also positioned partly within the wash pipe 43 and arranged around the washpipe 43. There are, as indicated with a process fluid line 54, in the washpipe 43 from the annular cavity 44 to the different compensator devices 61 provided internally, bores to avoid external fluid lines for process fluid and barrier fluid to the different compensator devices 61. Such a construction will give a compact device with minimal external fluid lines. Barrier fluid lines 55 from cylinder cavities 52 containing barrier fluid provide the pressure staging support for the seals. This is a parallel staging pressure support design as each piston 56 is driven directly by pressure from a bore 47 via the holes 42 and cavity 44 through the process fluid lines 54. It will later be shown that one new concept of the present invention is to have the staging as a series connection through the pistons which has some advantages for failure of one or more seals.

Figure 3:
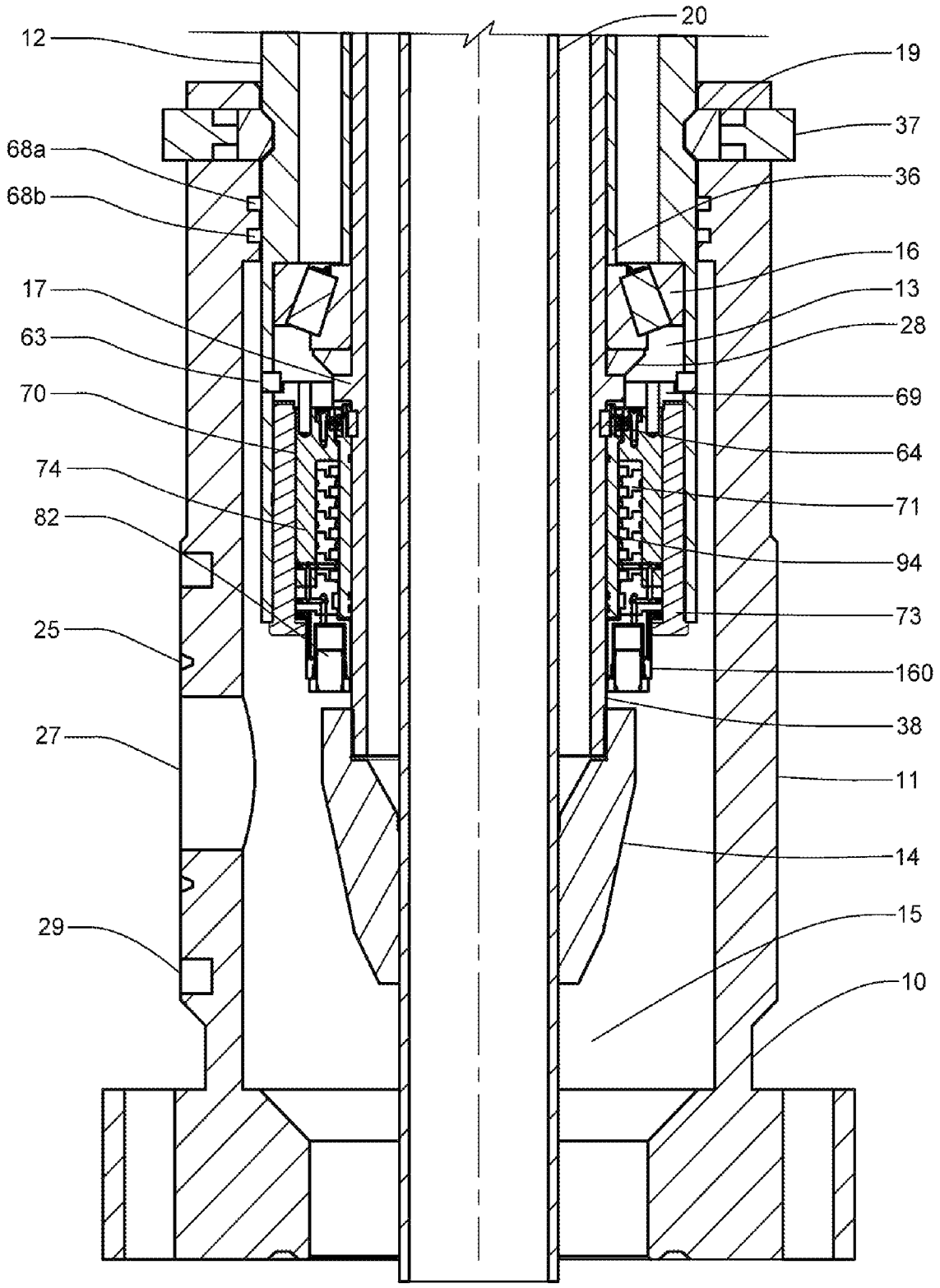
FIG. 3 is a schematic cross section of a multiple lip seal cartridge solution installed in a rotating control device.

FIG. 3 shows an RCD according to the present disclosure. The RCD is of the type illustrated in FIG. 1, and common features are labelled with the same reference numerals as used in FIG. 1. In this case, a multiple seal cartridge 70, illustrated schematically in FIG. 3, is positioned just below the lower bearing 16, replacing the lower seal carrier 32 of the prior art RCD. It is the intention of this invention that the multiple seal cartridge 70 takes the full pressure differential from the wellbore cavity 15 to the bearing cavity 13.

The multiple seal cartridge 70 is located inside the RCD housing and consists of the following primary components: a multiple seal assembly 71 which consists of six identical seals with spacers that seal against a seal sleeve 94, the seal sleeve 94 being part of the seal cartridge but, unlike the rest of the seal cartridge 70, is connected to the rotating control head mandrel 38 by a key 64 so that it rotates with the rotating control head mandrel 38. The key 64 merely prevents rotation of the seal sleeve 94 relative to the mandrel 38 and does not prevent the seal sleeve 94 from being removed from the mandrel 38 with the rest of the seal cartridge 70. The multiple seal assembly 71 is supported by a housing 74 that in turn is secured to the upper housing 12 of the rotating control head by a seal cartridge retainer 73. The seal cartridge 70 is prevented from rotating relative to the RCD housing by an anti-rotation bolt 63. The compensator pistons 82 that stage the pressure between the seals are also housed in a piston housing 160 that is a part of the multiple seal cartridge 70. The seal cartridge will at least have three seals and may have more than six seals.

FIG. 3 also shows an alternative installation method for the complete RCD cartridge. In this embodiment, the locking mechanism by means of which the upper housing 12 is secured to the lower housing 11 comprises locking dogs 19 that are driven by hydraulic pistons 37. The lower housing 11 is also provided with a mounting spool 10, by means of which the lower housing 11 can be attached to equipment below, usually an annular blow out preventer. The mounting spool 10 typically comprises a flange by means of which the lower housing 11 may be bolted to a standard large diameter API flange on a drilling riser, or an adapter on top of an annular blowout preventer. A pressure seal between the upper housing 12 and lower housing 11 is affected with seals 68*a* and 68*b*.

Advantageously, the multiple seal cartridge is a single assembly that can be easily installed and removed from the RCD mandrel 38 as is illustrated in following figures.

Figure 4B:
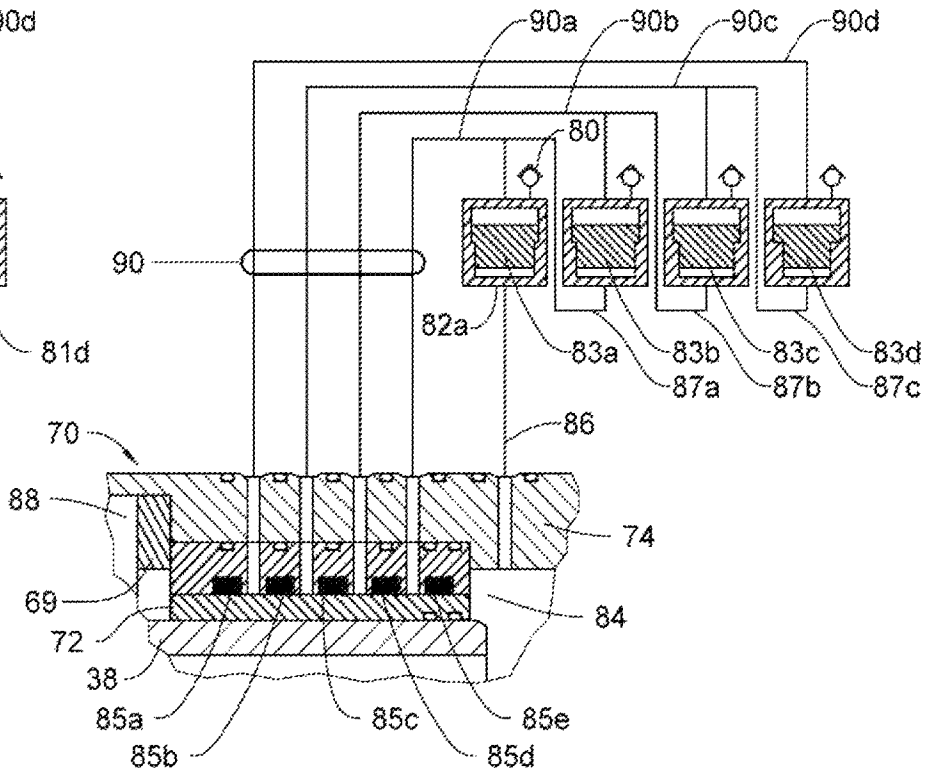
FIG. 4*b* shows the concept of series pressure staging.
Figure 4A:
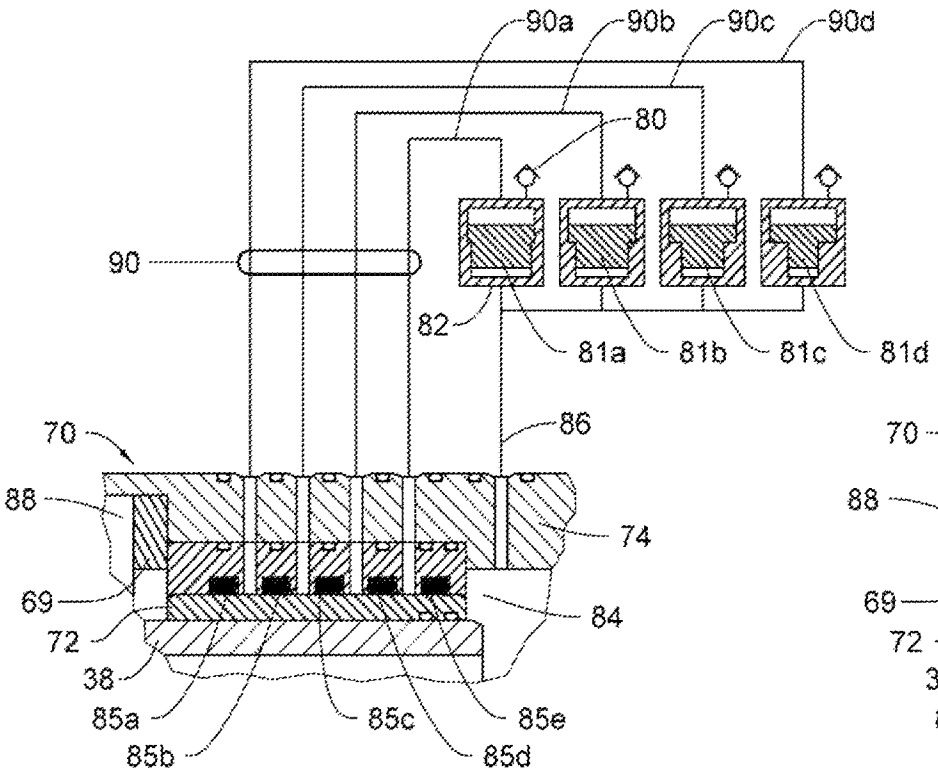
FIG. 4*a* shows the concept of parallel pressure staging.

Referring now to FIGS. 4*a* and 4*b*, another advantageous aspect of the disclosure will be discussed. FIG. 4*a* shows a parallel pressure staging configuration as commonly used and as was implemented in the U.S. Pat. No. 8,720,543 mentioned earlier. We have the rotating control device mandrel 38 with a partial section of the seal cartridge 70 shown in this case with only five seals 85*a* to 85*e* that are retained by the seal support housing 74. The rotating part of the seal cartridge 70 is the seal sleeve 94 that is connected to the RCD mandrel 38 by the key 64. Seals 85 are sealing a cavity 84 containing drilling mud from a bearing cavity 88. The bearing cavity 88 is at atmospheric pressure, and the cavity 84 with the drilling mud is holding the wellbore pressure which can be up to 5000 psi for this design. The seal 85*e* which has a first side which is exposed to the fluid in cavity 84, and a second side which is exposed to the fluid in the space between it and adjacent seal 85*d* is designated the first seal, and the seal 85*a* which has a first side which is exposed to fluid in the space between it and adjacent seal 85*b* and a second side which is exposed to atmospheric pressure is designated the second seal. The seals 85*b*, 85*c*, 85*d* which are arranged between the first seal 85*e* and the second seal 85*a* are intermediate seals.

The required PV (as discussed earlier) for this particular design is about 1,100,000 which is well above the operating PV of a single lip seal of 250,000. So the idea is to pressure stage the wellbore pressure across several seals. By way of example, this is achieved in FIG. 4*a* with four staging piston assemblies 82 that contain four pistons 81*a* to 81*d* with varying diameters. Each piston is located in a cylinder and divides the cylinder into an inlet volume and an outlet volume, the piston having an inlet face which is exposed to fluid pressure in the inlet volume and an outlet face which is exposed to fluid pressure in the outlet volume. The inlet volume of each piston 81*a*, 81*b*, 81*c*, 81*d* is connected to wellbore pressure from line 86, whilst the outlet side is individually filled with grease from grease zerks 80 and connected to one of the spaces between adjacent seals via lines 90*a*, 90*b*, 90*c* and 90*d* respectively. The area of the inlet face of each piston is smaller than the area of the outlet face, and there is a decrease in the ratio of the area of the inlet face to the area of the outlet face from the piston 81*a* connected to the volume adjacent the first seal 85*e* (which is exposed to the drilling fluid) to the piston 81*d* which is connected to the volume adjacent the second seal 85*a* (which is furthest from the wellbore pressure). The number of staging piston assemblies depends on the number of seals. Advantageously, one is provided for each seal.

In this embodiment, the varying piston diameters are proportionally split so that if wellbore pressure is 100%, then the output from lines 90*a* to 90*d* are 80%, 60%, 40% and 20% respectively of the wellbore pressure. So assuming e.g. that the wellbore pressure is 1000 psi, then seal 85*e* will see 1000 psi on the wellbore side and 800 psi on the other side, seal 85*d* will have 800 psi on the high-pressure side and 600 psi on the other side and so on for the other seals. Each seal will only be exposed to a differential pressure of 200 psi. As this is a directly proportional system, the pressure staging ratio stays the same for differing pressures, so for 2000 psi, each seal will see a differential of 400 psi.

The problem with a parallel piston design occurs if there is a seal failure. Typically, this will be the first seal 85*e* as it is directly exposed to the drilling fluid. If this first seal fails, then assuming 1000 psi wellbore pressure, the full 1000 psi is transferred to the second seal 85*d*. However, the compensating pressure being supplied to behind seal 85*d* by line 90*b* is only 60% of 1000 psi which is 600 psi. So suddenly the intermediate seal 85*d* next to the first seal 85*e* is exposed to 400 psi differential, which will lead to rapid failure as it is outside of the operating envelope. Once it fails, the situation is even worse for the next intermediate seal 85*c* leading to rapid failure. This cascade effect with ever increasing differential for the remaining seal directly exposed to wellbore pressure means that this is not a good solution. Moreover, the direct exposure of all of the compensating piston assemblies 82 to wellbore fluid from line 86 or direct exposure depending on the assembly detailed design also creates additional failure modes as the drilling fluid is contaminated with cuttings from the drilling operation.

Referring to FIG. 4*b* an advantageous embodiment of the pressure staging concept is disclosed termed: series pressure staging. Comparing this to the arrangement shown in FIG. 4*a*, all the parts are the same with the exception of two things. Firstly, wellbore pressure from line 86 is directed to only the inlet face of the first compensating piston assembly 82*a*. The outlet from the piston 83*a* goes to line 90*a* as the pressure support between the first seal 85*e* and its adjacent intermediate seal 85*d*, the same as for the configuration in FIG. 4*a*. In fact, the piston 83*a* is identical to piston 81*a* (FIG. 4*a*) and provides 80% of the wellbore pressure. The second difference is that the outlet volume of piston 83*a* is connected via line 87*a* to the inlet volume of piston 83*b*, and so on with each piston 83*c* and 83*d* receiving compensation pressure from the preceding piston. In other words, the pistons 83*a*, 83*b*, 83*c*, 83*d* are arranged in series. This has the effect that the compensating piston diameters are not as aggressively reduced as in the parallel arrangement because, for example, the second piston 83*b* is receiving only 80% of the wellbore pressure on the input side and thus, correspondingly, it will need a smaller piston differential area to convert this to 60% than if it was receiving 100% of wellbore pressure as in the parallel configuration of FIG. 4*a*. As pressure is proportional to area by definition, this difference can be easily illustrated if we gain or take 1000 psi wellbore pressure as an example. For the parallel case of FIG. 4*a*, if we assume 1000 pounds per square inch, then the first piston 81*a* must have a differential area of 0.2 square inches, the second one 0.4 square inches, third 0.6 square inches, and fourth 0.8 square inches. For the series case in FIG. 4*b*, the difference is much less after the first piston which will have the same differential area of 0.2 square inches. The second piston is only receiving 80% of the 1000 psi, so it only needs to have a differential area of 0.25 square inches, the third one only needs to have 0.33 square inches and fourth 0.5 square inches. The series compensation percentages are fixed in this type of arrangement by the mathematics of the compensation being 75%, 66.7% and 50% for a four-seal configuration; 80% 75%, 66.7% and 50% for a five-seal configuration as illustrated in FIG. 4*b* and 83.3%, 80%, 75%, 66.7% and 50% for a six-seal configuration and so on.

For the embodiment illustrated in FIG. 4*b*, if the first seal 85*e* fails, then we have 1000 psi on the second piston, which means the differential across the intermediate seals 85*d*, 85*c*, 85*b* and the second seal 85*a* will be 250 psi in all cases. So each seal has only seen an increase of about 25% of PV spread equally across all the seals compared to the doubling of the PV for the next seal in line for the parallel case. In fact, in this case with 1000 psi, even if two seals fail, we are at 333 psi differential for each remaining seal which is still better than the single seal failure differential of 400 psi for the parallel case. Furthermore, in the series piston design, only one piston is exposed to the drilling fluid media, which is easier to protect with a diaphragm arrangement compared to the multiple inlets of the parallel design as detailed later in FIG. 12.

Figure 5B:
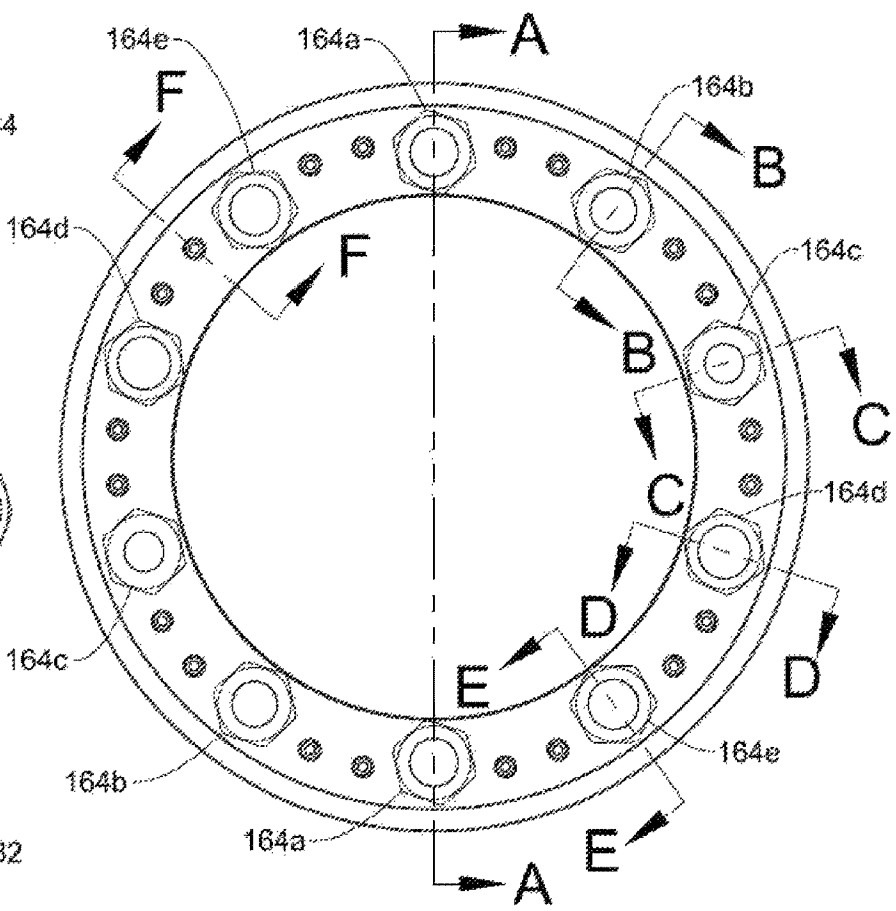
FIG. 5*b* shows a bottom view of the same seal cartridge.
Figure 5A:
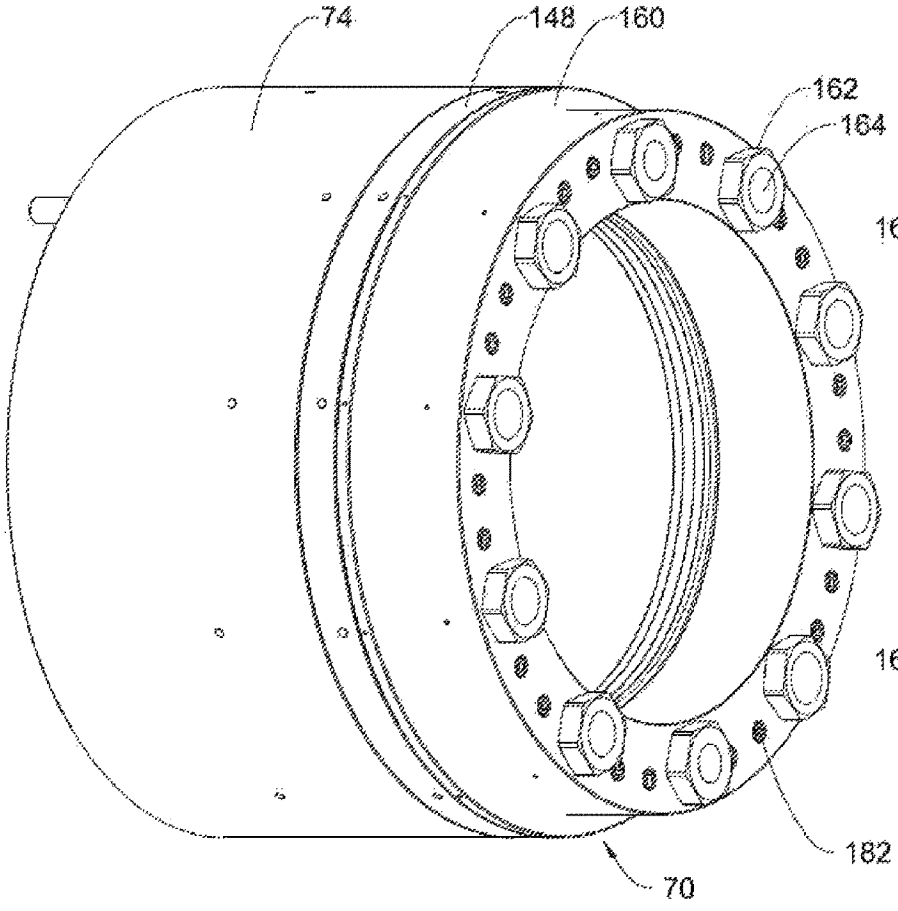
FIG. 5*a* shows an isometric view of a prototype seal cartridge with parallel staging.

In FIGS. 5*a* and 5*b*, the cartridge concept of the present disclosure is explained. In FIG. 5*a*, we see an isometric view of the seal cartridge 70, which can slide as a single complete unit over the RCD mandrel 38 (not shown). When the seal cartridge 70 needs replacing, the hydraulic pistons 37 which drive the locking dogs 19 are operated to retract the locking dogs 19, so that the upper housing 12 can be detached from the lower housing 11, which remains secured in position by mounting spool 10. The RCD mandrel 38 is then lifted with the upper housing 12, bearing assembly, and seal cartridge 70 in place. The elastomeric stripper 14 is removed from the end of the RCD mandrel 38, and the seal cartridge 70 can then be detached from the upper housing 12 by detaching the seal cartridge retainer 73 from the upper housing 12, and the seal cartridge 70 dismounted from the RCD mandrel 38. This process can then be reversed to install a replacement or refurbished seal cartridge 70. The seal cartridge 70 is placed around the lowermost end of the RCD mandrel 38 and slid into position in the upper housing 12. The seal cartridge retainer 73 is then reinstalled to secure the seal cartridge 70 to the upper housing 12 and the original elastomeric stripper 14 or a new elastomeric stripper mounted on the end of the RCD mandrel 38. The RCD mandrel 38, complete with upper housing 12, bearing assembly and seal cartridge 70 can then be lowered back onto the lower housing 11, and the hydraulic pistons 37 operated to move the locking dogs 19 to lock the upper housing onto the lower housing 11. This is very different from all the state-of-the-art RCD designs which require a step by step dismantling of components to access the seals. Here, the seal cartridge 70 can be easily removed and a new or refurbished seal cartridge installed allowing the maintenance of the working seals to be carried out off-site or without time pressure because the main RCD assembly, as in the case of a non-cartridge design, is out of service. These non-cartridge designs need to have a complete bearing and seal assembly on standby at the wellsite. This does not make sense as the bearings have a much longer life than the seals. In fact, the single biggest cause of bearing failure on conventional RCDs is the failure of the seals, leading to mud invasion of the bearing(s) and to rapid failure. So, by having a cartridge design which simplifies the replacement of the main wear component: the seals against the rotating mandrel 38, a more cost effective, reliable and easily field serviceable solution is presented.

In FIG. 5*a*, the seal cartridge 70 consists of two major parts, the multiple seal support housing 74 and a lower packing sleeve 148 and the piston housing 160 which houses piston housing sleeves 162 with seal pistons 164 arranged circumferentially. This embodiment is an illustration of the parallel compensation system as shown in FIG. 4*a*, as all the seal pistons 164 are exposed to wellbore fluid. It is the intent of the present disclosure to show a new series type compensation system as will be seen later, though this will have some similar design features of the minor components. The piston housing 160 is bolted to the lower packing sleeve 148 with bolts 182. In FIG. 5*b*, we show various cross sections that will be used to explain detailed features.

Figure 6:
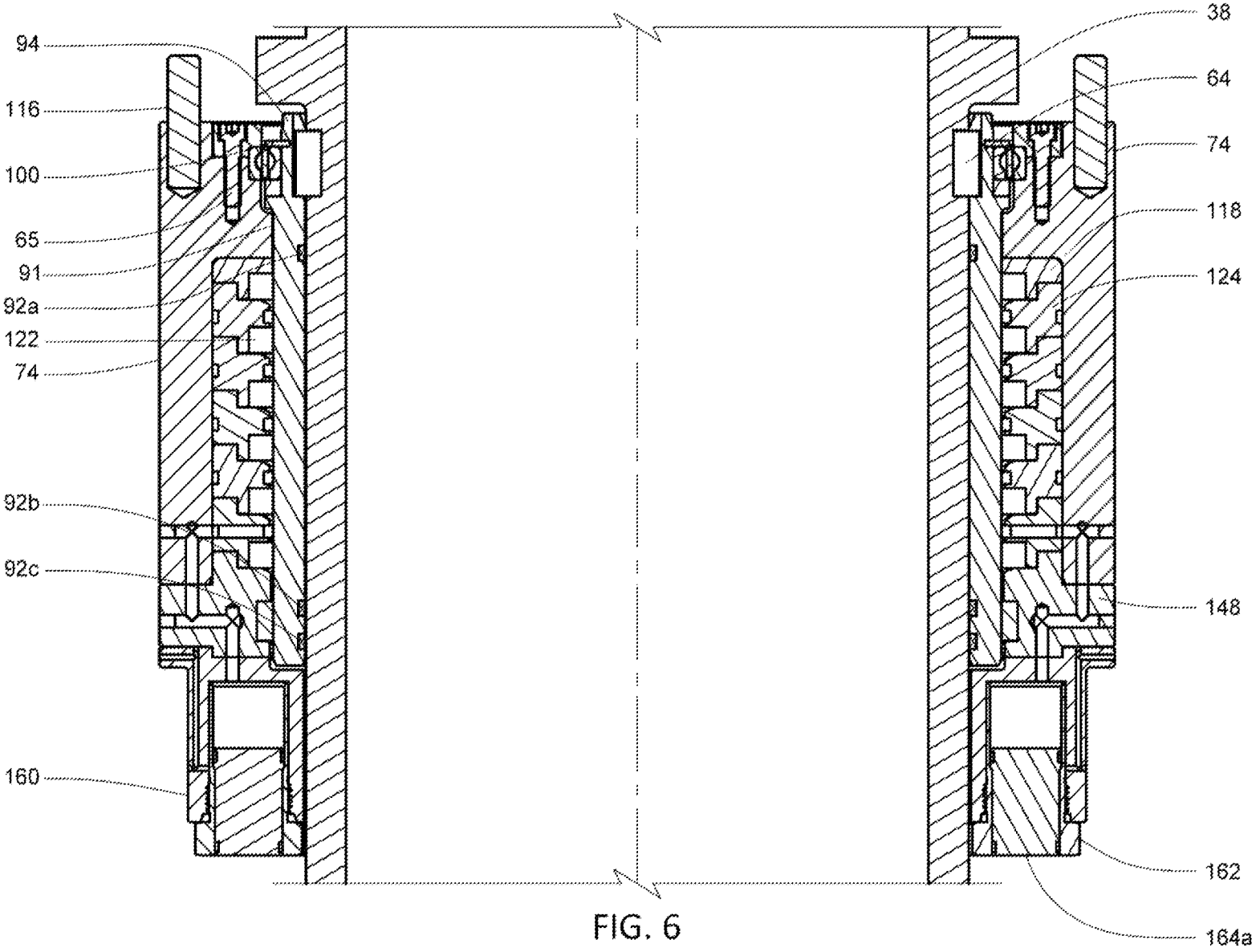
FIG. 6 is a schematic cross section at A-A of FIG. 5*b* with the RCD mandrel included.

FIG. 6 is the cross-section A-A from FIG. 5*b* of the seal cartridge 70 with the addition of the RCD mandrel 38 to illustrate the cartridge concept. The main components are detailed here with the seal details explained in FIG. 7*a*. We can see the lower packing sleeve 148 and the seal support housing 74 as well as the seal sleeve 94. The seal sleeve 94 is secured to the seal support housing 74 via a bearing 100 as described in more detail below. These are the main components of the seal cartridge 70. The introduction of the seal sleeve 94 is an advantageous feature of this invention as it stops direct contact of the lip seals with the rotating RCD mandrel 38. On conventional RCD designs, the seals typically run directly on the mandrel, and, even though lip seals are soft compared to the metal of the mandrel, fine grooves are worn into the conventional RCD mandrels which then leads to leaks and subsequent failure. Preventive maintenance for the conventional design means removing and replacing the whole mandrel, which means complete disassembly of the RCD bearing assembly. In this novel design, the seal sleeve 94 is prevented from rotation relative to the mandrel 38 with the mandrel key 64. This locks the sleeve to the mandrel 38 and it is sealed with seals 92*a*, 92*b* and 92*c*. This makes an interface 91 the rotating interface to the seals. As this seal sleeve 94 is part of the seal cartridge, it can be easily replaced when the seal cartridge 70 is serviced without having to dismantle the complete RCD bearing assembly. It also allows superior surface coatings and materials to be used on and for the seal sleeve 94. Furthermore, another advantageous feature is that with this design, all the main lip seals 122 are of exactly the same dimensions and shape leading to economies of scale.

The gap at interface 91 is carefully controlled and optimized by the use of the bearing 100 between the seal sleeve 94 and the seal support housing 74. The seal support housing has anti-rotation pins 116 that are connected to the upper housing 12 (not shown in FIG. 6). The seal stack consisting of main seals 122 and support components 118 and retainers 124 will be explained in FIG. 7*a*. In another embodiment (not illustrated), it is envisioned that the seal sleeve 94 can be moved axially by a small amount so that a fresh surface is exposed to the seals 122. Over time, even soft seals wear grooves into the harder seal sleeve 94 which is usually steel or coated steel. This reduces seal performance, and, by moving the seal sleeve 94, we can extend its useful life. As such, in one embodiment, the RCD is provided with a seal adjustment mechanism which is operable to move the seals relative to the seal sleeve generally parallel to the axis of the mandrel without detaching either the seal sleeve from the mandrel or the seal assembly from the RCD housing. This could be achieved either by moving the seal assembly relative to the RCD housing, for example, by providing the mandrel key 64 with an adjustable nut mechanism or by moving the seal sleeve 94 relative to the mandrel.

Figure 7A:
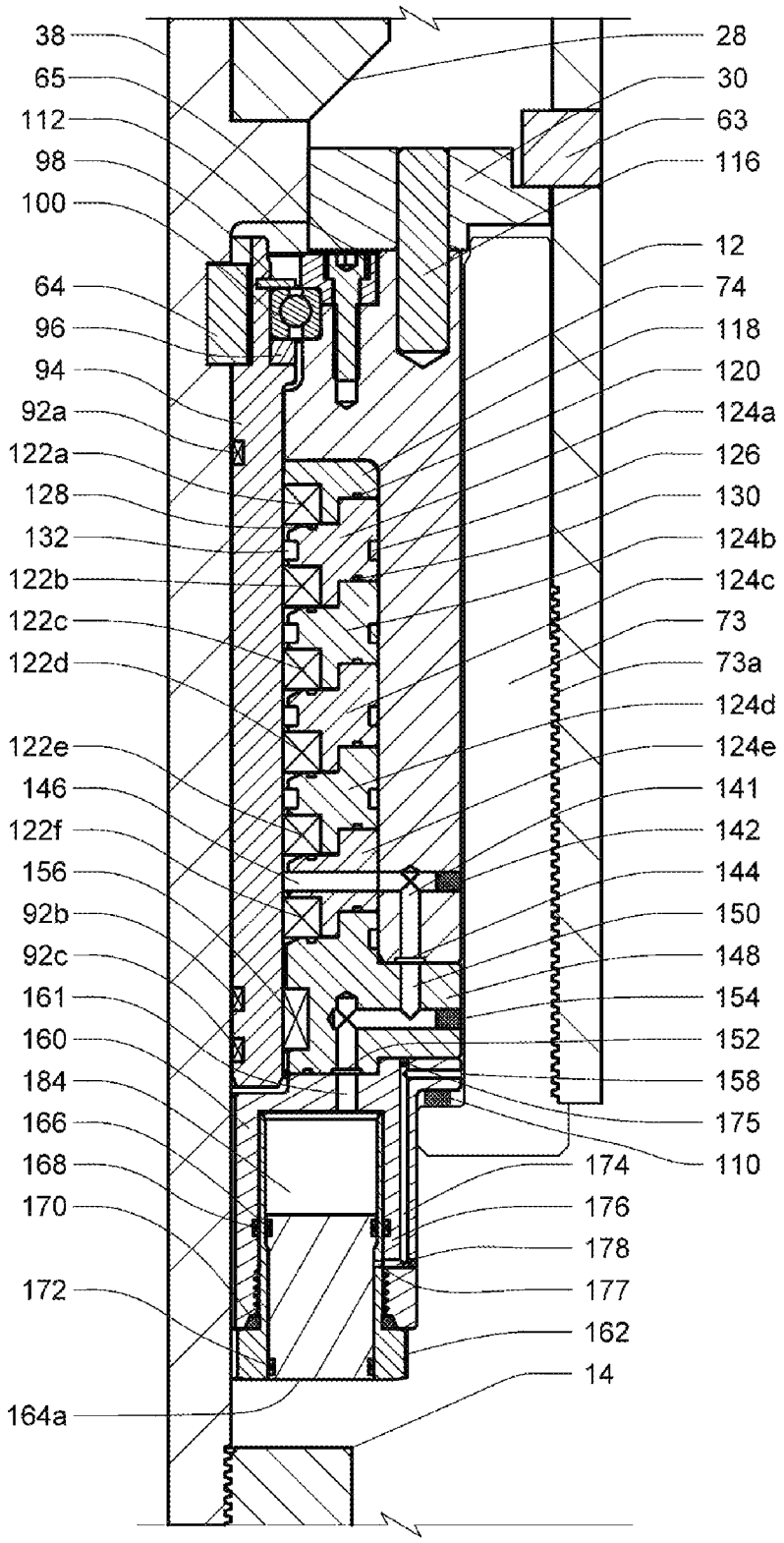
FIG. 7*a* is a detailed view of the partial cross section A-A with the RCD mandrel included.

For FIG. 7*a*, we detail the parts that have not yet been described, starting from top to bottom. Bolts 65 hold a bearing retainer ring 112 for the bearing 100. The other half of the bearing is retained by a second retainer ring 98. There is a bearing spacer 96. The threaded adapter 30 is locked in place by an anti-rotation bolt 63 to fix the seal support housing 74 to the upper housing 12 via the anti-rotation pins 116. After the seal cartridge 70 is removed as described above, the seal sleeve 94 can be detached by removing the bolts 65 to release the bearing retainer ring 112, and the seal sleeve 94 and associated bearing 100 can then be slid off the seal housing 74. If required, it can then be replaced with a new seal sleeve assembly before the bearing retainer ring 112 is returned and bolted to the seal housing 74 again.

For the seal stack, there are six identical seals 122*a-f*. The seal 122*f* has a first side exposed to fluid at the pressure of the fluid in the cavity 15 of the RCD housing 11 and a second side exposed to the fluid in the space between it and the adjacent seal 122*e* which is designated by the first seal. The seal 122*a* has a first side which is exposed to fluid in the space between it and adjacent seal 122*b* and a second side which is exposed to atmospheric pressure is designated the second seal. The seals 122*b*, 122*c*, 122*d* and 122*e* which are arranged between the first seal 85*e* and the second seal 85*a* are intermediate seals. These may be lip seals, Kalsi seals or any other type of flexible seal able to handle the rotating interface 91. The seals are stacked and isolated from each other by seal retainers starting with the support components 118 sitting above the second seal 122*a* and then five more identical seal retainers 124*a* to 124*e*. These may be of any material type. Each one of the retainers 124 has an inner seal groove 132 and an outer seal groove 126. Each of the retainers 124 has one set of O-rings 120, 128 and 130 which serve to give full pressure isolation for each main seal 122*a* to 122*f*. Whilst the first side of the first seal 122*f* could be in direct contact with fluid in the RCD housing 11 (i.e. drilling mud), in this case, there is a trash seal 156 which serves to isolate the main seals from direct contact with drilling mud. This is a non-pressure isolating seal meaning that it allows pressure communication in both directions. As such, the first side of the first seal 122*f* is exposed to fluid at the same pressure as the fluid in the RCD housing 11. At the bottom installed in the piston housing 160, we have the piston housing sleeve 162 with seals 168 and 170 containing a plurality of pistons 164*a*, 164*b*, 164*c*, 164*d*, 164*e*, of which one, piston 164*a*, is illustrated in FIG. 7*a*. This is sealed to the sleeve with two seals 166 and 172. This piston 164*a* is acted on by wellbore pressure and an internal piston sleeve cavity 184 is filled with grease, oil or other suitable lubricant. The piston has a differential area, so it transmits only a percentage of wellbore pressure through port 161, 150, 141 to port 146 which is in communication with the inner seal groove 132 and outer seal groove 126 of seal retainer 124*e*. This provides the pressure support across main seal 122*f*. In order for the piston 164*a* to move freely, a set of ports 177, 176 and 174 lead to an external port 158 which provides pressure equalization. Items 178, 175, 154 and 142 are sealing plugs installed after boring the various ports. O-rings 150 and 152 ensure full pressure isolation from the piston sleeve cavity 184 up to the port 146.

Figure 7B:
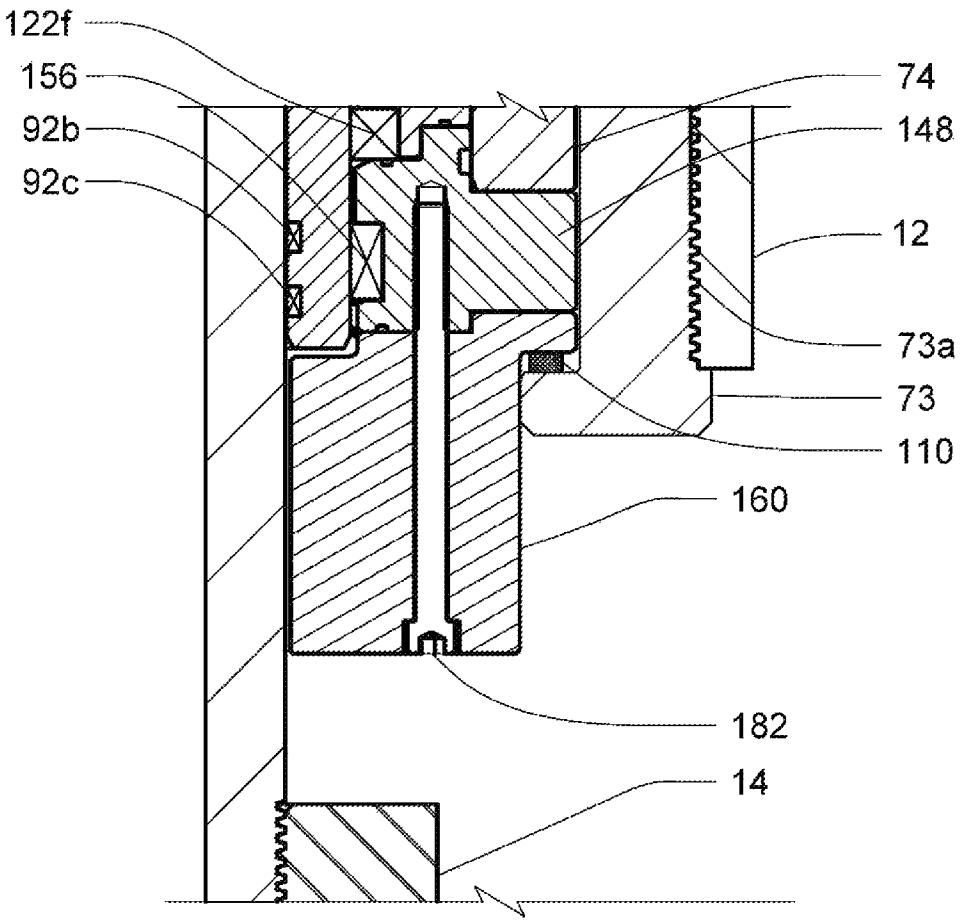
FIG. 7*b* is a cross section F-F showing detail of attachment.
Figures 8A, 8B, 8C, 8D:
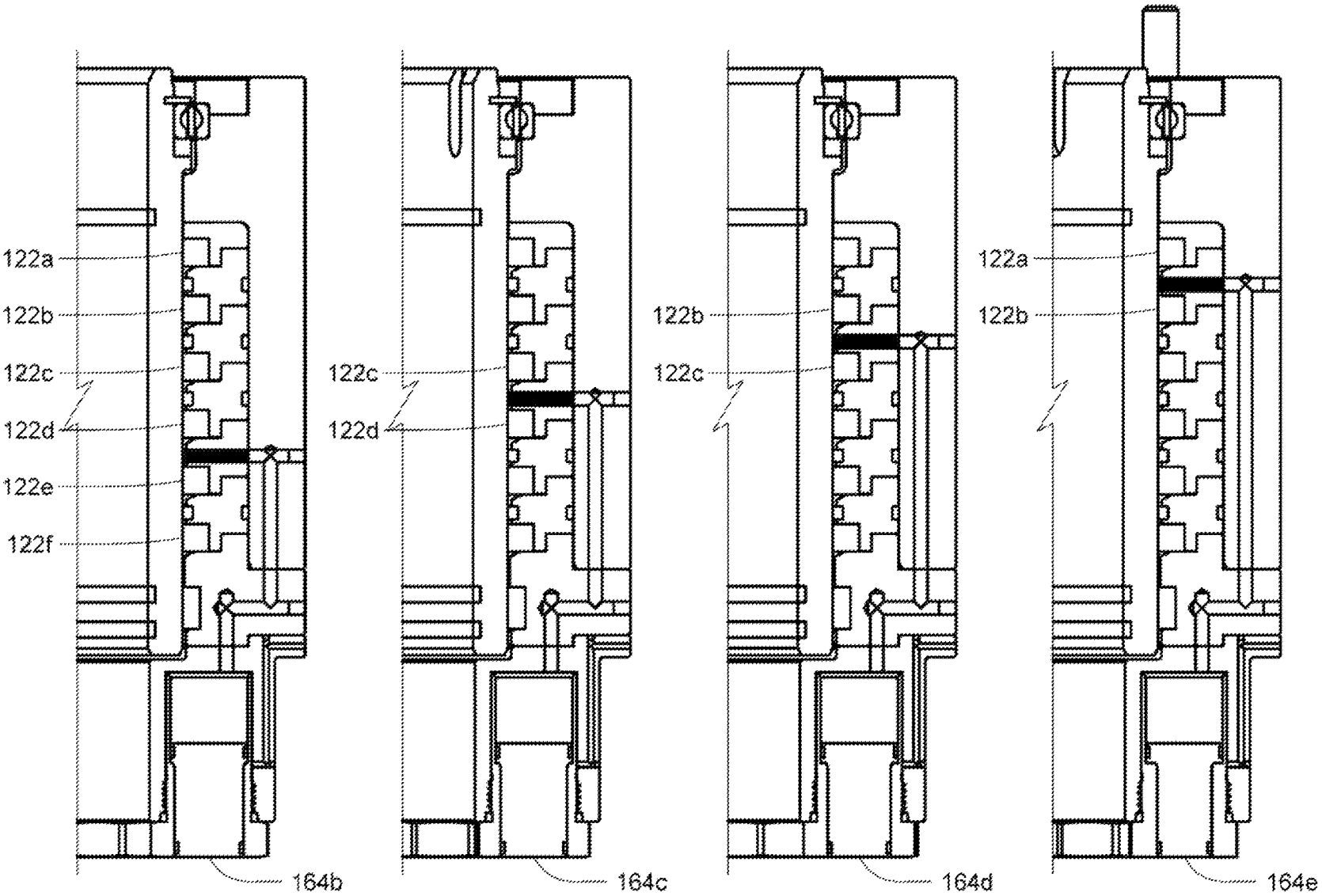
FIGS. 8*a* to 8*d* are showing further cross sections of the assembly from FIG. 5*b;*

In FIG. 7*b*, the cross-section F-F from FIG. 5*b* details fixation of the piston housing 160 to the lower packing sleeve 148 with bolts 182. The whole seal cartridge assembly is held in place by the seal cartridge retainer 73, which, in this example, is an outer retainer sleeve that is threaded into the upper housing 12 via a screw thread 73*a*. A low friction seal 110 provides pressure isolation.

FIGS. 8*a*, 8*b*, 8*c* and 8*d* are respectively representative cross sections B-B, C-C, D-D and E-E from FIG. 5*b*. For FIG. 8*a*. piston 164*b* has a reduced diameter towards wellbore pressure which is ported to provide pressure support between main seals 122*d* and 122*e*. For FIG. 8*b*, piston 164*c* has a reduced diameter compared to piston towards wellbore pressure which is ported to provide pressure support between main seals 122*c* and 122*d*. For FIG. 8*c*, piston 164*d* has a reduced diameter towards wellbore pressure which is ported to provide pressure support between main seals 122*b* and 122*c*. For FIG. 8*d*, piston 164*e* has a reduced diameter towards wellbore pressure which is ported to provide pressure support between main seals 122*a* and 122*b*. In this parallel pressure support design, two pistons are used for each pressure support stage as can be seen on FIG. 5*b*. This system gives a staged pressure support for the main seals 122.

Figure 9B:
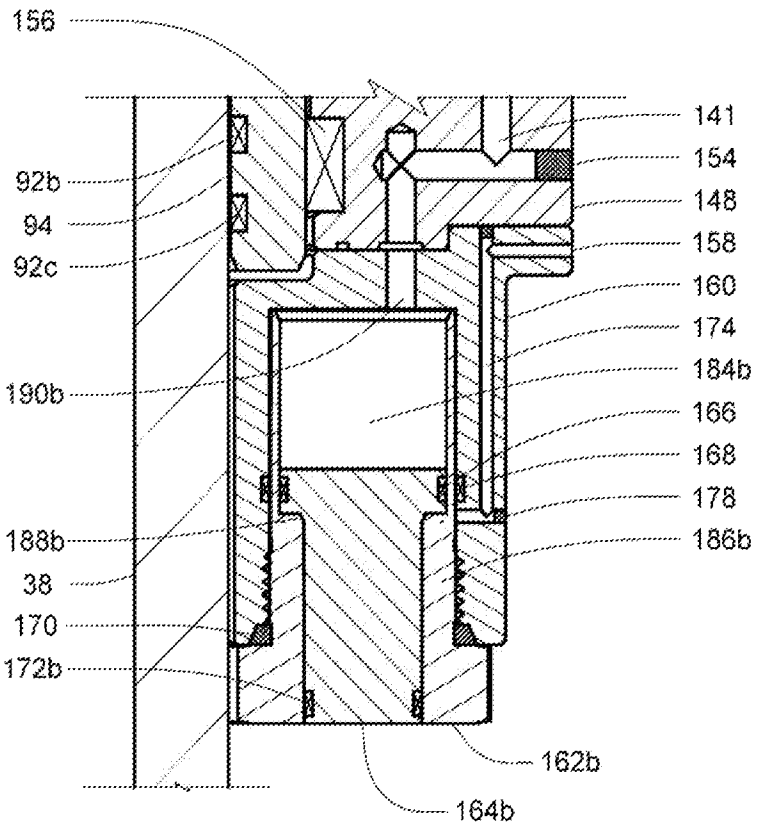
FIGS. 9*a* and 9*b* are schematic cross sections of two of the staging pistons.
Figure 9A:
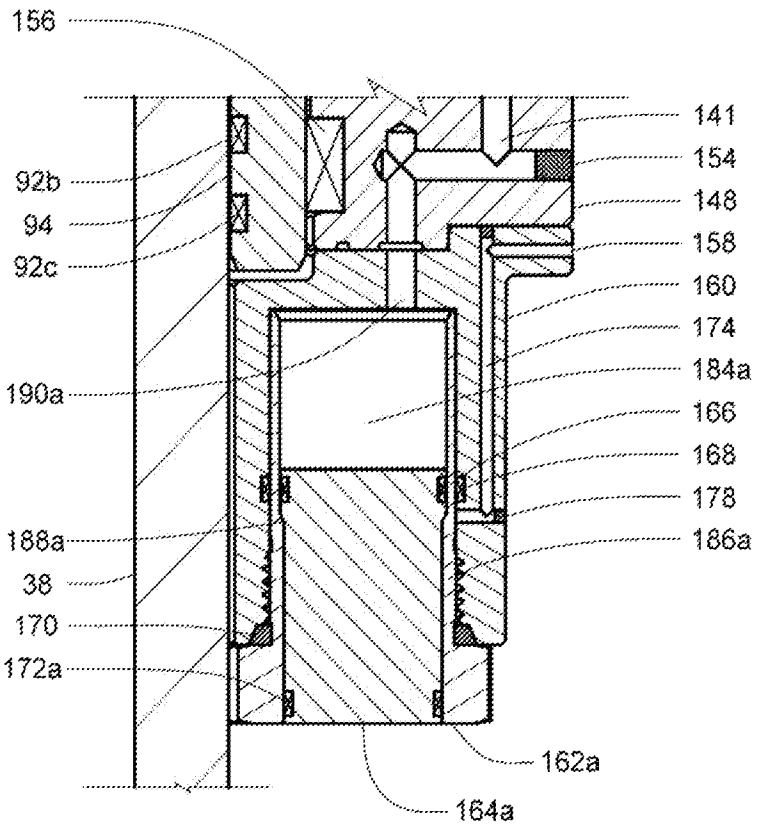

Another disclosed feature is the use of cartridge design for the pressure supporting cylinders. This is illustrated in FIGS. 9*a* and 9*b*. In comparing the piston housing seal sleeves 162*a* and 162*b*, we note that the external diameters and the seals 170 and 168 to the piston housing 160 are identical. This means that all the machined ports in the piston housing are identical. This allows a cartridge design of the piston sleeves 162, with only the internals differing like piston 164*b* having a smaller external diameter than 164*a*. This allows quick customization as well as easy change out of the pressure compensating pistons.

Figure 10:
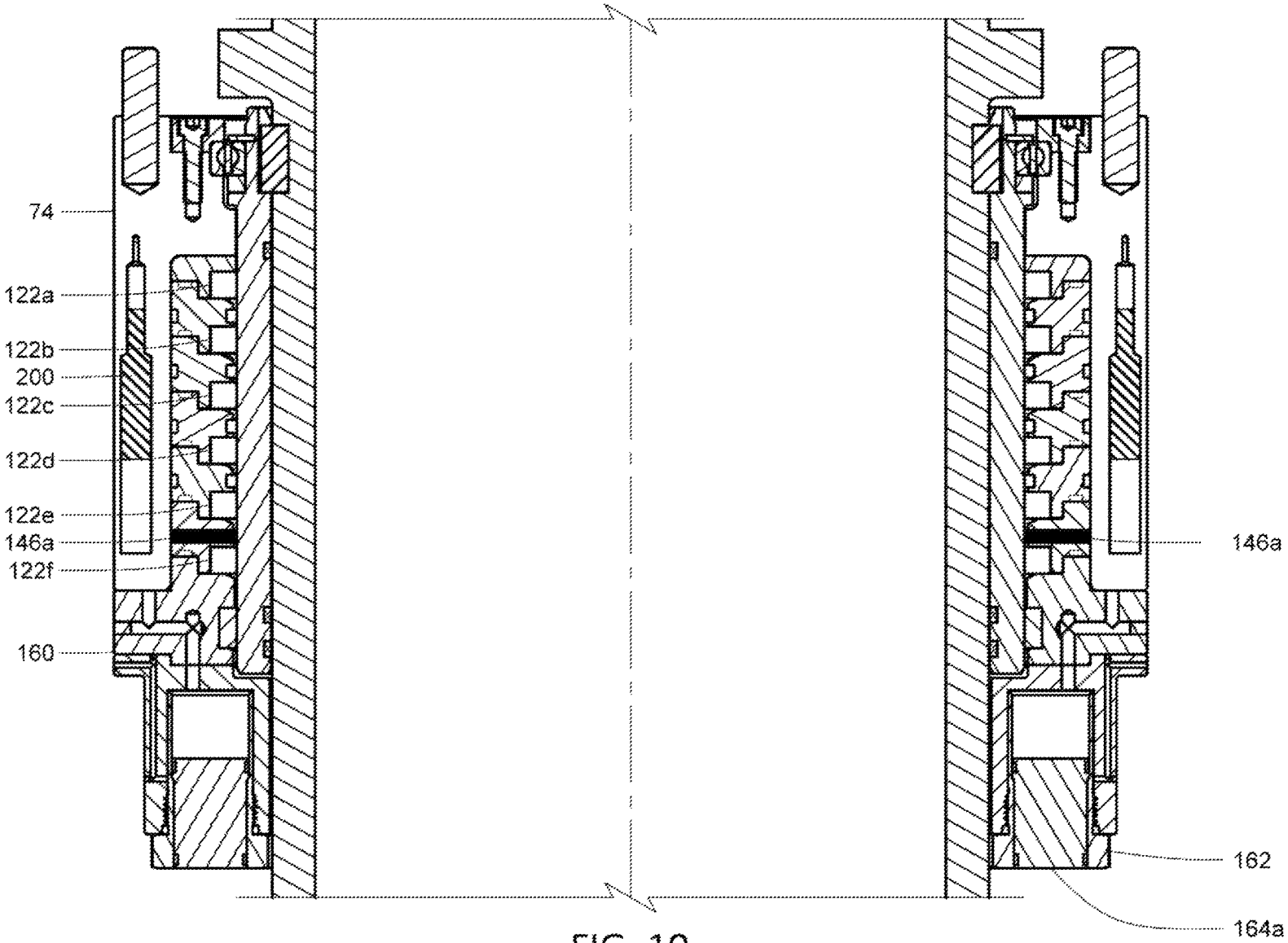
FIG. 10 shows an embodiment with series pressure staging.
Figures 11A, 11B, 11C, 11D:
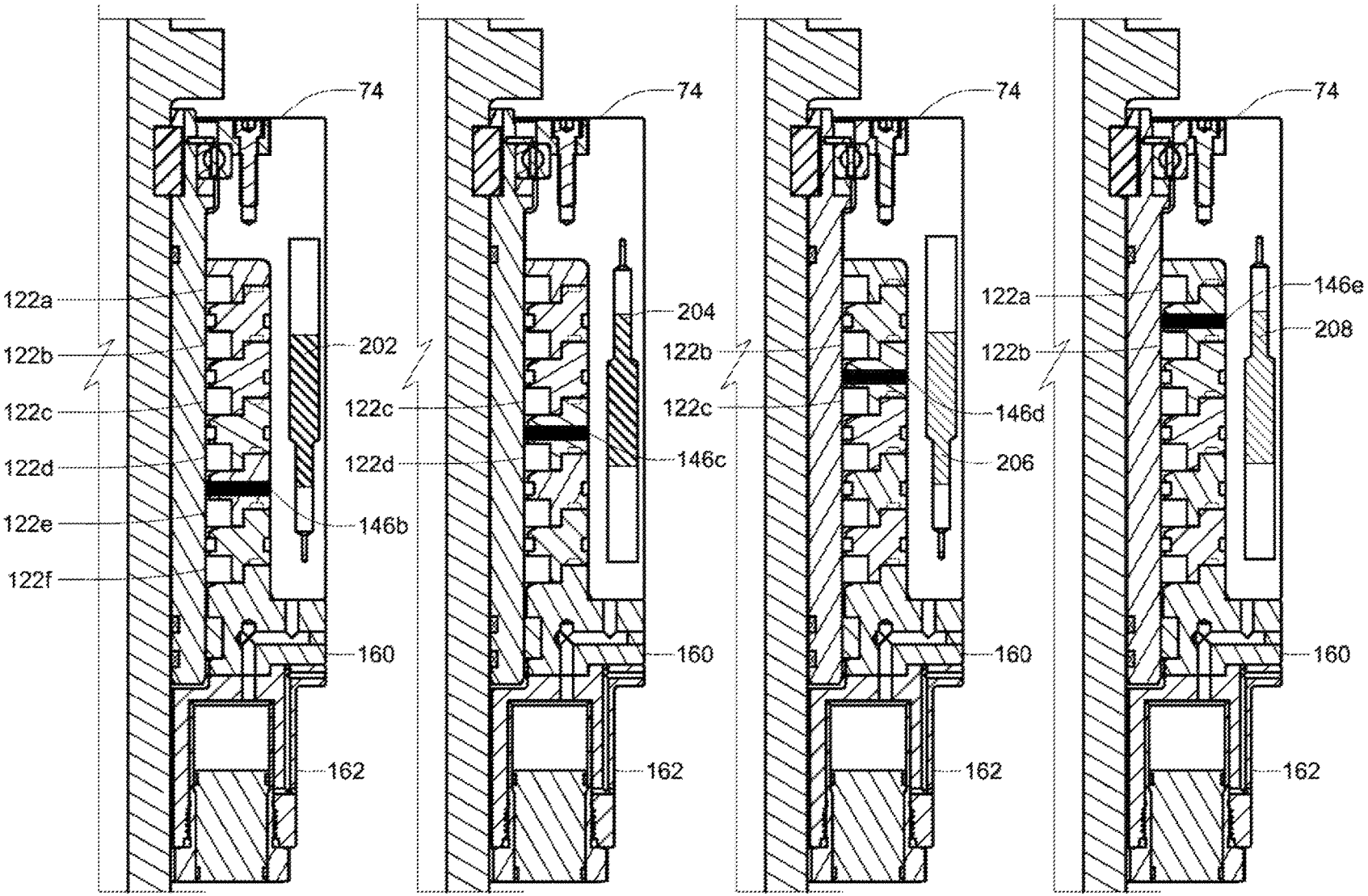
FIGS. 11*a* to 11*d* are showing further details of series staged pistons in a different embodiment.

It is the intent of this disclosure to utilize a series pressure compensation system as illustrated in FIG. 4*b*. This is schematically shown in FIG. 10 and in FIGS. 11*a* to 11*d*. In FIG. 10, the supply piston sleeve 162 and supply piston 164*a* are similar to the arrangement shown in FIGS. 6 and 7*a*. However, the supply piston 164*a* has no differential area, as its purpose is to convey wellbore pressure to piston assembly 200, which introduces the first pressure step between seals 122*e* and 122*f*. Thereafter, the piston 200 is connected to a piston 202 in the manner described in FIG. 4*b*. The pistons 200 and 202 are shown in different positions and are situated in the seal support housing 74 as another embodiment of the seal cartridge design. It is also possible to situate these cylinder assemblies in the piston housing 160 and drilling the necessary porting for a series configuration in the seal support housing. FIGS. 11*a* to 11*d* show the sequence of arrangement of the cylinder assemblies 202, 204, 206 and 208 to provide pressure support between seals 122*d/e*, 122*c/d*, 122*b/c* and 122*a/b* respectively. By inverting the cylinder/piston assemblies, easier porting is provided for connecting them in, as can be seen when comparing pistons 200 and 202, 202 and 204 and so on. The detailed porting is not shown, just the main pressure ports 146*b*, 146*c*, 146*d* and 146*e*.

Figure 12:
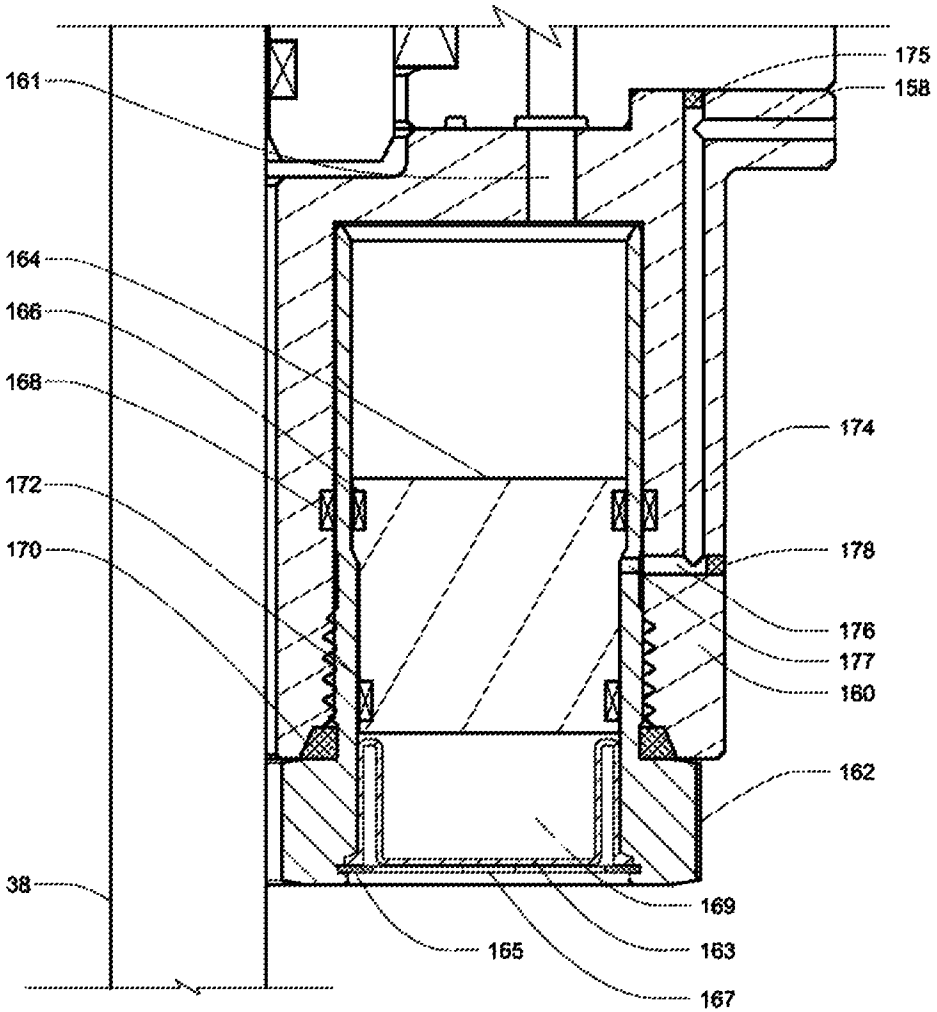
FIG. 12 details the diaphragm arrangement for protecting the first stage piston from wellbore fluids.

In summary, a pressure sealing system is described that utilizes two or more seals with stepped pressure support between the seals 122 preferentially in series configuration for the reasons described under FIG. 4*b*. The seals 122, the seal sleeve 94, and the compensation pistons are arranged in a single circumferential cartridge that can be installed and reinstalled from the RCD mandrel 38 without disassembly of the bearing assembly. FIG. 12 shows the piston seal sleeve 162 with the piston 164 that is identical to the one described in FIG. 7*a*. The preferential embodiment here is the addition of a flexible diaphragm 163 that is secured in place with a retainer clip 165 that includes a sieve 167 to prevent large debris from touching the diaphragm. A diaphragm cavity 169 is filled with grease. This is a preferred solution that prevents direct contact of the drilling fluid with the moving piston seal 172.

While the trash seal 156 described above is a non-pressure isolating seal, it should be appreciated that it could equally be a pressure-isolating seal. In this case, the pressure stepping mechanism may further includes means for supplying fluid to the space between the trash seal and the first seal at a pressure which is the same or greater than the fluid in the RCD housing. In this case, the pressure stepping mechanism could include a trash supply cylinder having a trash supply piston which divides the cylinder into an inlet volume and an outlet volume, the inlet volume being in communication with fluid in the RCD housing and the outlet volume being in fluid communication with the space between the trash seal and the first seal, the trash supply piston having an inlet face which is exposed to fluid pressure in the inlet volume and an outlet face which is exposed to fluid pressure in the outlet volume, the area of the inlet face being substantially the same as the area of the outlet face (in order to supply fluid at the same pressure as the fluid in the RCD housing), or greater than the area of the outlet face (in order to supply fluid at a pressure which is greater than the pressure of the fluid in the RCD housing). The inlet volume of the trash supply cylinder may be protected from direct contact with the fluid in the RCD housing by means of diaphragm, as discussed in relation to FIG. 12 above.

In this case, the rotating control device may also be provided with an additional non-pressure isolating trash seal, the pressure isolating the main trash seal 156 being located between the first seal 122*f* and the non-pressure isolating additional trash seal, the additional trash seal acting to protect the main trash seal 156 from direct contact with drilling mud. In the parallel arrangement described above in relation to FIGS. 7*a* and 8*a*, 8*b*, 8*c* & 8*d*, inlet faces of the pistons 164*a*, 164*b*, 164*c*, 164*d* & 164*e* are acted on by the fluid in the RCD housing, i.e. by wellbore pressure, either directly as illustrated in these figures, or indirectly by the use of a diaphragm as described in relation to FIG. 12. The same applies to piston 164*a* in the series arrangement described above in relation to FIGS. 10, 11*a*, 11*b*, 11*c* & 11*d*. The inlet faces of these pistons could, equally however, by acted on by the fluid at the first side of the first seal 122*f*, which, where a pressure isolating trash seal is provided as described in paragraph 54 above, could be at a greater pressure than the fluid in the RCD housing. This could be achieved by providing fluid communication between the inlet volume of each of these pistons and the space between the trash seal 156 and the first seal 122*f*.

Although the disclosure has been described with reference to specific embodiments, these descriptions are not meant to be construed in a limiting sense. Various modifications of the disclosed embodiments, as well as alternative embodiments of the disclosure, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A rotating control device for use in a drilling system, the rotating control device comprising:

a non-rotating tubular RCD housing enclosing an elongate passage;

a mandrel which extends along the elongate passage, the mandrel having an axis and an end on which is mounted an elastomeric stripper which is located in the RCD housing and which is configured to seal against and rotate relative to the RCD housing about said axis with a drill pipe located inside the mandrel and extending along said axis; and a seal assembly which is located in the RCD housing and which is configured to provide a substantially fluid tight seal between the RCD housing and the mandrel, wherein the seal assembly comprises:

a seal support housing with first and second seals which seal against an exterior surface of the mandrel, the first and second seals being spaced from one another generally parallel to the axis of the mandrel so that there is a space around the mandrel between the first and second seals, the first seal having a first side which is exposed to fluid at a pressure greater than or equal to the pressure of fluid in the RCD housing and a second side which is exposed to fluid in the space between the seals, the second seal having a first side which is exposed to fluid pressure in the space between the seals and a second side which is exposed to fluid pressure at the exterior of the RCD housing;

a pressure stepping mechanism which pressurizes fluid to a pressure which is intermediate between the pressure at the first side of the first seal and the pressure at the second side of the second seal and supplies said fluid to the space between the two seals; and the pressure stepping mechanism being integral with or secured to the seal support housing.

2. A rotating control device according to claim 1, wherein the seal assembly comprises, at least one intermediate seal which is located in the space between the first seal and the second seal, and divides the space around the mandrel between the first seal and the second seal into a plurality of spaces which are spaced from one another generally parallel to the axis of the mandrel, the at least one intermediate seal having a first side which is exposed to fluid pressure in the space between the intermediate seal and the first seal or its adjacent seal closest to the first seal and a second side which is exposed to fluid pressure in the space between the intermediate seal and the second seal or its adjacent seal closest to the second seal, the pressure stepping mechanism being configured to supply fluid to each space between adjacent seals, the pressure of fluid being supplied to the space between the first seal and its adjacent seal being lower than the pressure of fluid in the RCD housing, the pressure of fluid being supplied to the space between the second seal and its adjacent seal being greater than the fluid pressure at the exterior of the RCD housing but lower than the pressure of fluid supplied to the space between the first seal and its adjacent seal, and the fluid pressure in all the spaces between adjacent seals decreases from the space adjacent the first seal to the space adjacent the second seal.

3. A rotating control device according to claim 1, wherein the pressure stepping mechanism comprises, for each space between adjacent seals, a cylinder containing a piston which divides the cylinder into an inlet volume and an outlet volume, the outlet volume being in fluid communication with its respective space between adjacent seals, the piston having an inlet face which is exposed to fluid pressure in the inlet volume and an outlet face which is exposed to fluid pressure in the outlet volume, the area of the inlet face being less than the area of the outlet face.

4. A rotating control device according to claim 3, wherein the pressure stepping mechanism is configured such that the inlet volume of each cylinder is in fluid communication with fluid in the RCD housing or with fluid at the same pressure as fluid in the RCD housing or with fluid at the first side of the first seal.

5. A rotating control device according to claim 3, wherein the seal assembly comprises, at least one intermediate seal which is located in the space between the first seal and the second seal, and divides the space around the mandrel between the first seal and the second seal into a plurality of spaces which are spaced from one another generally parallel to the axis of the mandrel, the at least one intermediate seal having a first side which is exposed to fluid pressure in the space between the intermediate seal and the first seal or its adjacent seal closest to the first seal and a second side which is exposed to fluid pressure in the space between the intermediate seal and the second seal or its adjacent seal closest to the second seal, the pressure stepping mechanism being configured to supply fluid to each space between adjacent seals, the pressure of fluid being supplied to the space between the first seal and its adjacent seal being lower than the pressure of fluid at the first side of the first seal, the pressure of fluid being supplied to the space between the second seal and its adjacent seal being greater than the fluid pressure at the exterior of the RCD housing but lower than the pressure of fluid supplied to the space between the first seal and its adjacent seal, and the fluid pressure in all the spaces between adjacent seals decreases from the space adjacent the first seal to the space adjacent the second seal, and the ratio of the area of the inlet face to the area of the outlet face of each piston decreases moving from the piston controlling the supply of pressurized fluid to the space adjacent the first seal to the piston controlling the supply of pressurized fluid to the space adjacent the second seal.

6. A rotating control device according to claim 3, wherein the seal assembly comprises, at least one intermediate seal which is located in the space between the first seal and the second seal, and divides the space around the mandrel between the first seal and the second seal into a plurality of spaces which are spaced from one another generally parallel to the axis of the mandrel, the at least one intermediate seal having a first side which is exposed to fluid pressure in the space between the intermediate seal and the first seal or its adjacent seal closest to the first seal and a second side which is exposed to fluid pressure in the space between the intermediate seal and the second seal or its adjacent seal closest to the second seal, the pressure stepping mechanism being configured to supply fluid to each space between adjacent seals, the pressure of fluid being supplied to the space between the first seal and its adjacent seal being lower than the pressure of the fluid at the first side of the first seal, the pressure of fluid being supplied to the space between the second seal and its adjacent seal being greater than the fluid pressure at the exterior of the RCD housing but lower than the pressure of fluid supplied to the space between the first seal and its adjacent seal, and the fluid pressure in all the spaces between adjacent seals decreases from the space adjacent the first seal to the space adjacent the second seal, the pressure stepping mechanism having a first cylinder which controls the supply of pressurized fluid to the space adjacent the first seal, the inlet volume of the first cylinder being in fluid communication with fluid in the RCD housing or with fluid at the same pressure as fluid in the RCD housing or with fluid at the first side of the first seal, whilst the inlet volumes of all other cylinders are each in communication with the outlet volume of the cylinder controlling the supply of pressurized fluid to the space adjacent to its respective space and closer to the first seal (its preceding cylinder) so that the pressure in the inlet volume of each of the other cylinders is substantially the same as the pressure in the outlet volume of its preceding cylinder.

7. A rotating control device according to claim 6, wherein for each cylinder other than the first cylinder, a fluid flow passage is provided between the inlet volume and the outlet volume of its preceding cylinder.

8. A rotating control device according to claim 7, wherein the pressure stepping mechanism comprises, a supply cylinder having a supply piston which divides the cylinder into an inlet volume and an outlet volume, the inlet volume being in fluid communication with fluid in the RCD housing and the outlet volume being in fluid communication with the inlet volume of the first cylinder, the supply piston having an inlet face which is exposed to fluid pressure in the inlet volume and an outlet face which is exposed to fluid pressure in the outlet volume, the area of the inlet face being substantially the same as the area of the outlet face.

9. A rotating control device according to claim 1, further comprising a trash seal which seals against an exterior surface of the mandrel and which is adjacent to but spaced from the first side of the first seal, so as to form a space around the mandrel between the trash seal and the first seal, the trash seal having a first side which is exposed to fluid in the RCD housing and a second side which is exposed to fluid in the space between the trash seal and the first side of the first seal.

10. A rotating control device according to claim 9, wherein the trash seal is a pressure isolating seal, and the pressure stepping mechanism supplying fluid to the space between the trash seal and the first seal at a pressure which is the same or greater than the fluid in the RCD housing and including a trash supply cylinder having a trash supply piston which divides the cylinder into an inlet volume and an outlet volume, the inlet volume being in fluid communication with fluid in the RCD housing and the outlet volume being in fluid communication with the space between the trash seal and the first seal, the trash supply piston having an inlet face which is exposed to fluid pressure in the inlet volume and an outlet face which is exposed to fluid pressure in the outlet volume, the area of the inlet face being substantially the same as the area of the outlet face.

11. A rotating control device according to claim 9, wherein the trash seal is a pressure isolating seal, and the pressure stepping mechanism supplying fluid to the space between the trash seal and the first seal at a pressure which is the same or greater than the fluid in the RCD housing and including a trash supply cylinder having a trash supply piston which divides the cylinder into an inlet volume and an outlet volume, the inlet volume being in fluid communication with fluid in the RCD housing and the outlet volume being in fluid communication with the space between the trash seal and the first seal, the trash supply piston having an inlet face which is exposed to fluid pressure in the inlet volume and an outlet face which is exposed to fluid pressure in the outlet volume, the area of the inlet face being larger than the area of the outlet face.

12. A rotating control device according to claim 1, further comprising, a bearing assembly which supports the mandrel for rotation in the RCD housing, wherein the seal assembly is arranged to isolate the bearing assembly from pressurized fluid in the RCD housing, and engages with the mandrel between the stripper and the bearing assembly.

13. The rotating control device according to claim 1, wherein the pressure stepping mechanism includes a cylinder containing a piston which divides the cylinder into an inlet volume and an outlet volume, the inlet volume receiving fluid from the volume in the RCD housing around the elastomeric stripper, or fluid which is pressure balanced with the fluid in the RCD housing around the elastomeric stripper.

14. A rotating control device for use in a drilling system, the rotating control device comprising:

a non-rotating tubular RCD housing enclosing an elongate passage;

a mandrel which extends along the elongate passage, the mandrel having an axis and an end on which is mounted an elastomeric stripper which is located in the RCD housing and which is configured to seal against and rotate relative to the RCD housing about said axis with a drill pipe located inside the mandrel and extending along said axis; and a seal assembly which is configured to provide a substantially fluid tight seal between the RCD housing and the mandrel, the seal assembly comprising:

a seal support housing with first and second seals which seal against an exterior surface of the mandrel, the first and second seals being spaced from one another generally parallel to the axis of the mandrel so that there is a space around the mandrel between the first and second seals, the first seal having a first side which is exposed to fluid at a pressure greater than or equal to the pressure of fluid in the RCD housing and a second side which is exposed to fluid in the space between the seals, the second seal having a first side which is exposed to fluid pressure in the space between the seals and a second side which is exposed to fluid pressure at the exterior of the RCD housing;

a pressure stepping mechanism which pressurizes fluid to a pressure which is intermediate between the pressure at the first side of the first seal and the pressure at the second side of the second seal and supplies said fluid to the space between the two seals, the pressure stepping mechanism being integral with or secured to the seal support housing and comprising a cylinder containing a piston which divides the cylinder into an inlet volume and an outlet volume, the inlet volume receiving fluid from the volume in the RCD housing around the elastomeric stripper, or fluid which is pressure balanced with the fluid in the RCD housing around the elastomeric stripper; and wherein the seals, the seal support housing and the pressure stepping mechanism are located inside the RCD housing and are releasably attached to the RCD housing, and can be removed from the RCD housing together as a single unit.

15. A rotating control device according to claim 14, wherein the seals seal against a seal sleeve which is mounted on the exterior of the mandrel and fixed for rotation with the mandrel, the seal sleeve being detachable from the mandrel for removal from the RCD housing with the seals, the seal support housing and the pressure stepping mechanism.

16. A rotating control device according to claim 14, wherein each seal is located in a separate seal carrier within the seal support housing, each seal carrier being provided with a pressure isolating seal which provides a substantially fluid tight seal between the seal carrier and the seal support housing, and the seal support housing, the seal carriers and the pressure stepping mechanism are releasably attached to the RCD housing, and can be removed from the RCD together as a single unit.

17. A rotating control device according to claim 14, further comprising, a bearing assembly which supports the mandrel for rotation in the RCD housing, wherein the seal assembly is arranged to isolate the bearing assembly from pressurized fluid in the RCD housing, and the seals, the seal support housing and the pressure stepping mechanism are releasably attached to the RCD housing, and can be removed from the RCD housing together as a single unit whilst leaving the mandrel and bearing assembly in place in the RCD housing.

18. A rotating control device according to claim 14, wherein the RCD housing comprises, an upper housing and a lower housing, and the rotating control device comprises a locking mechanism by means of which the upper housing may be locked to the lower housing, the locking mechanism being operable to release the upper housing from the lower housing, wherein the seals, the seal support housing and the pressure stepping mechanism are releasably attached to the upper housing.

19. A rotating control device for use in a drilling system, the rotating control device comprising:

a non-rotating tubular RCD housing enclosing an elongate passage;

a mandrel which extends along the elongate passage, the mandrel having an axis and an end on which is mounted an elastomeric stripper which is located in the RCD housing and which is configured to seal against and rotate relative to the RCD housing about said axis with a drill pipe located inside the mandrel and extending along said axis;

a bearing assembly which supports the mandrel for rotation in the RCD housing; and a seal assembly which is configured to provide a substantially fluid tight seal between the RCD housing and the mandrel and to isolate the bearing assembly from pressurized fluid in the RCD housing, the seal assembly comprising:

a seal support housing with first and second seals which seal against an exterior surface of the mandrel, the first and second seals being spaced from one another generally parallel to the axis of the mandrel so that there is a space around the mandrel between the first and second seals, the first seal having a first side which is exposed to fluid at a pressure greater than or equal to the pressure of fluid in the RCD housing and a second side which is exposed to fluid in the space between the seals, the second seal having a first side which is exposed to fluid pressure in the space between the seals and a second side which is exposed to fluid pressure at the exterior of the RCD housing;

a cylinder containing a piston for pressurizing fluid to a pressure which is intermediate between the pressure at the first side of the first seal and the pressure at the second side of the second seal and supplies said fluid to the space between the two seals and being integral with or secured to the seal support housing, the piston divides the cylinder into an inlet volume and outlet volume, the inlet volume receiving fluid from the volume in the RCD housing around the elastomeric stripper, or fluid which is pressure balanced with the fluid in the RCD housing around the elastomeric stripper; and wherein the seals, the seal support housing and the pressure stepping mechanism are located inside the RCD housing and are releasably attached to the RCD housing, and can be removed from the RCD together as a single unit, whilst leaving the mandrel and the bearing assembly in place in the RCD housing.

20. A rotating control device according to claim 19, wherein the seals seal against a seal sleeve which is mounted on the exterior of the mandrel and fixed for rotation with the mandrel, the seal sleeve being detachable from the mandrel for removal from the RCD housing with the seals, the seal support housing and the pressure stepping mechanism.

21. A rotating control device according to claim 19, wherein each seal is located in a separate seal carrier within the seal support housing, each seal carrier being provided with a pressure isolating seal which provides a substantially fluid tight seal between the seal carrier and the seal support housing, and the seal support housing, the seal carriers and the pressure stepping mechanism are releasably attached to the RCD housing, and can be removed from the RCD together as a single unit.

* * * * *